US010731850B2

(12) United States Patent
Taniguchi et al.

(10) Patent No.: US 10,731,850 B2
(45) Date of Patent: Aug. 4, 2020

(54) SOLID FUEL BURNER

(71) Applicant: MITSUBISHI HITACHI POWER SYSTEMS, LTD., Yokohama-shi, Kanagawa (JP)

(72) Inventors: Masayuki Taniguchi, Yokohama (JP); Akira Baba, Yokohama (JP); Koji Kuramashi, Yokohama (JP); Shota Ishii, Yokohama (JP)

(73) Assignee: MITSUBISHI HITACHI POWER SYSTEMS, LTD., Yokohama-shi, Kanagawa (JP)

( * ) Notice: Subject to any disclaimer, the term of this patent is extended or adjusted under 35 U.S.C. 154(b) by 6 days.

(21) Appl. No.: 15/740,482

(22) PCT Filed: Jun. 22, 2016

(86) PCT No.: PCT/JP2016/068469
§ 371 (c)(1),
(2) Date: Dec. 28, 2017

(87) PCT Pub. No.: WO2017/002675
PCT Pub. Date: Jan. 5, 2017

(65) Prior Publication Data

US 2018/0195716 A1 Jul. 12, 2018

(30) Foreign Application Priority Data

Jun. 30, 2015 (JP) ..... 2015-131146

(51) Int. Cl.
*F23D 1/02* (2006.01)
*F23D 1/00* (2006.01)

(52) U.S. Cl.
CPC ..... *F23D 1/02* (2013.01); *F23D 1/00* (2013.01); *F23D 2201/10* (2013.01); *F23D 2201/20* (2013.01); *F23D 2900/01001* (2013.01)

(58) Field of Classification Search
CPC ..... F23D 1/02
See application file for complete search history.

(56) References Cited

U.S. PATENT DOCUMENTS 2,793,686 A * 5/1957 Phillips ..... F23D 11/00 431/183
4,457,241 A 7/1984 Itse et al.
(Continued)

FOREIGN PATENT DOCUMENTS

GB 303226 A 1/1929
GB 377474 A 7/1932
(Continued)

OTHER PUBLICATIONS

International Search Report dated Aug. 16, 2016, issued in Counterpart of International Application No. PCT/JP2016/068469 (2 pages).
(Continued)

*Primary Examiner* — Nathaniel Herzfeld
(74) *Attorney, Agent, or Firm* — Westerman, Hattori, Daniels & Adiran, LLP

(57) ABSTRACT

A solid fuel burner is provided with a nozzle that is provided around the central axis of the burner, that includes a straight tube section having an opening opposed to a furnace, and a curved tube section continuous with the straight tube section, and that sprays out, from the opening to the furnace, a fluid mixture which is of a solid fuel and carrier gas of the solid fuel and which is flowing in the curved tube section; a first swirler that gives the fluid mixture a swirl at the burner central axis side of the straight tube section; and a second
(Continued)

swirler that gives, at the burner central axis side downstream of the first swirler, the fluid mixture a swirl opposite to that given by the first swirler.

14 Claims, 21 Drawing Sheets

(56) References Cited

U.S. PATENT DOCUMENTS

| | | | | |
|---|---|---|---|---|
| 4,464,108 | A * | 8/1984 | Korenyi | F23D 11/408 239/402 |
| 4,479,442 | A | 10/1984 | Itse et al. | |
| 4,654,001 | A | 3/1987 | LaRue | |
| 4,930,430 | A * | 6/1990 | Allen | F23D 1/00 110/264 |
| 5,529,000 | A * | 6/1996 | Hartel | F23D 1/00 110/104 B |
| 5,823,764 | A * | 10/1998 | Alberti | F23C 7/006 431/184 |
| 5,829,367 | A * | 11/1998 | Ohta | F23D 1/00 110/261 |
| 5,937,770 | A * | 8/1999 | Kobayashi | F23D 1/00 110/263 |
| 2004/0139894 | A1 | 7/2004 | Vatsky et al. | |
| 2009/0061374 | A1* | 3/2009 | De Jong | C10J 3/487 431/354 |
| 2009/0272303 | A1 | 11/2009 | Courtemanche et al. | |
| 2010/0154688 | A1 | 6/2010 | Adam et al. | |
| 2010/0154689 | A1 | 6/2010 | Adam et al. | |
| 2013/0029274 | A1* | 1/2013 | Yousif | F23C 7/008 431/253 |
| 2013/0305971 | A1* | 11/2013 | Hamel | F23C 7/006 110/264 |
| 2014/0352582 | A1* | 12/2014 | Taniguchi | F23C 99/00 110/346 |
| 2015/0068438 | A1 | 3/2015 | Taniguchi et al. | |
| 2015/0362181 | A1 | 12/2015 | Adam et al. | |

FOREIGN PATENT DOCUMENTS

| | | | |
|---|---|---|---|
| JP | 58-164910 | A | 9/1983 |
| JP | 58-224208 | A | 12/1983 |
| JP | 2-50008 | A | 2/1990 |
| JP | 9-26112 | A | 1/1997 |
| JP | 2756098 | B2 | 5/1998 |
| JP | 2010-181145 | A | 8/2010 |
| JP | 2012-513012 | A | 6/2012 |
| WO | 2010/080221 | A2 | 7/2010 |
| WO | 2013/099593 | A1 | 7/2013 |
| WO | 2013/141311 | A1 | 9/2013 |

OTHER PUBLICATIONS

English translation of International Preliminary Report on Patentability (Form PCT/IPEA/409) issued in counterpart International Application No. PCT/JP2016/068469 dated Jun. 22, 2016, with Form PCT/IB/338. (6 pages).

* cited by examiner

SOLID FUEL BURNER

TECHNICAL FIELD

The present disclosure relates to a solid fuel burner using coal, biomass, and the like as a fuel.

BACKGROUND ART

In a combustion apparatus using a solid fuel, in order to achieve stable ignition and flame holding, supplying a mixed fluid (a mixed fluid of the fuel and a carrier gas thereof) containing a sufficient concentration of fuel to a flame holding part of a burner outlet is required. As a conventional technology for concentrating the solid fuel inside the burner, there are Patent Documents 1 and 2 below.

Patent Document 1 discloses a pulverized coal burner which includes a pulverized coal pipe having a curved tube section and a straight tube section for injecting a mixed fluid of a solid fuel and a carrier gas thereof, wherein a throttle section for throttling a flow path nearer a central axis is provided at immediately after the curved tube section, and the mixed fluid is sprayed and burned in a furnace by applying a swirl to a flow of the fluid by a swirler before an outlet of the straight tube section.

Patent Document 2 discloses a pulverized coal burner 21 as illustrated in FIG. 21. In a pulverized coal supply pipe 29 having a curved tube section 25 and a straight tube section 22 for injecting a mixed fluid of a solid fuel and a carrier gas thereof, a liquid fuel injection pipe 28 is provided on a central axis of the straight tube section 22, a secondary air supply pipe 23 and a tertiary air supply pipe 24 are disposed around the pulverized coal supply pipe 29, and a secondary airflow and a tertiary airflow are supplied toward a furnace 13. Further, the above patent discloses a configuration in which a pulverized coal concentration in a circumferential direction is made uniform by providing a swirl vane 26 downstream of the flow of the mixed fluid in the curved tube section 25, and a swirl strength of the flow is reduced by installing a swirl degree adjustment vane 27 in the vicinity of a burner outlet, as well as ignitability of flame of the pulverized coal is improved by making the mixed fluid close to a straight flow.

CITATION LIST

Patent Document

[Patent Document 1] Japanese Unexamined Patent Application Publication No. H2-50008

[Patent Document 2] Japanese Patent Publication No. 2756098

SUMMARY OF INVENTION

Technical Problem

According to, the configuration described in the above Patent Document 1, by applying a swirl to the mixed fluid by the swirler before the outlet part, the mixed fluid is dispersed in the furnace to secure ignitability and stability of the flame. However, when the mixed fluid is excessively spread in the furnace, this fluid is mixed with a combustion air such as a secondary air or tertiary air at an early stage, such that it is disadvantageous for reduction of nitrogen oxide (NOx).

According to the configuration described in Patent Document 2, due to the swirl vane near the curved section of the pulverized coal supply pipe and the adjustment vane near the outlet, it is possible to adjust the mixed fluid to be introduced into the furnace to an optimum swirl degree.

Meanwhile, pulverized coal ignites from a portion where a local concentration of the pulverized coal is high in a flow field of the mixed fluid, and the flame spreads around the portion. That is, in order to improve the ignitability of the pulverized coal, it is necessary to create a portion having a locally high concentration of pulverized coal in the flow field. This is particularly important for improving combustion stability at a low load in which an average concentration of the pulverized coal is low.

Accordingly, it is better that the pulverized coal concentration in the mixed fluid is nonuniform to some extent, and a portion having a dense pulverized coal concentration is formed at an opening edge part of the burner (an end edge part of a fuel nozzle) or a flame stabilizer provided therein, so that the ignitability is increased, and stable combustion may be achieved even at a lower load.

However, in Patent Document 2, the primary object is to ensure the pulverized coal concentration in the circumferential direction is uniform, and in a case of a particularly low load, the pulverized coal concentration may fall below the ignition lower limit concentration equally in the circumferential direction. As a result, it is difficult to ignite the flame, and stable combustion may not be maintained.

Further, the adjustment vane of Patent Document 2 is a straightening plate in which a plurality of vanes are attached to an inner wall of the pipe so as to be substantially parallel to an axial center of the pulverized coal supply pipe. Accordingly, unless the length of the plate in the axial direction thereof is somewhat large, the action for reducing the swirl degree may not be obtained, which leads to an increase in a size of the vanes and, consequently, to an increase in a size of the burner. Further, since installation and attachment of the swirl vane and the adjustment vane require a large amount of labor and time, it is not preferable in terms of maintainability and installation costs.

It is an object of the present disclosure to provide a solid fuel burner which is superior in ignitability and flame stability, and is also superior in maintainability at a low cost even at the time of a low load with a low fuel concentration.

Solution to Problem

The above object may be achieved by employing the following configurations.

An invention of a first aspect is a solid fuel burner (1) provided in a throat (13*a*) of a wall surface of a furnace (13), including: a fuel nozzle (9) which includes a straight tube section (2) provided around a burner central axis and having an opening toward the furnace (13) and a curved tube section (5) continued to the straight tube section (2), wherein a mixed fluid of a solid fuel and a carrier gas thereof supplied to the curved tube section (5) is sprayed from the opening of the straight tube section (2) to the furnace (13); a first swirling means (6) which is provided on the burner central axis side in the straight tube section (2), and is provided away from an inner wall (9*a*) of the fuel nozzle (9) to apply a swirl to the mixed fluid; and a second swirling means (7) which is provided on the burner central axis side downstream in a flow direction of the mixed fluid of the first swirling means (6), and is provided away from an inner wall (9*a*) of the fuel nozzle (9) to apply a swirl to the mixed fluid in a direction reverse to that of the first swirling means (6), wherein the second swirling means (7) is disposed on the upstream side in a direction in which the mixed fluid is carried from the opening of the straight tube section (2) with a preset interval so that a swirl component by the second swirling means (7) does not remain.

An invention of a second aspect is the solid fuel burner according to the first aspect, wherein a flame stabilizer (10) is provided on an outer periphery of the opening of the straight tube section (2).

An invention of a third aspect is a solid fuel burner (1) provided in a throat (13*a*) of a wall surface of a furnace (13), including: a fuel nozzle (9) which includes a straight tube section (2) provided around a burner central axis and having an opening toward the furnace (13) and a curved tube section (5) continued to the straight tube section (2), wherein a mixed fluid of a solid fuel and a carrier gas thereof supplied to the curved tube section (5) is sprayed from the opening of the straight tube section (2) to the furnace (13); a first swirler (6) which is provided, in the straight tube section (2), includes a plurality of vanes (6*a*) installed in the circumferential direction, and is provided away from an inner wall (9*a*) of the fuel nozzle (9) to apply a swirl to the mixed fluid; and a second swirler (7) which is provided downstream in a flow direction of the mixed fluid of the first swirler (6) in the straight tube section (2), includes a plurality of vanes (7*a*) disposed in the circumferential direction, is provided away from an inner wall (9*a*) of the fuel nozzle (9), and is installed in a direction reverse to a direction in which vanes (6*a*) of the first swirler (6) are installed, wherein the second swirling means (7) is disposed on the upstream side in a direction in which the mixed fluid is carried from the opening of the straight tube section (2) with a preset interval so that a swirl component by the second swirling means (7) does not remain.

An invention of a fourth aspect of the present disclosure is the solid fuel burner according to the third aspect, wherein a flame stabilizer (10) is provided on the outer periphery of the opening of the straight tube section (2).

An invention of a fifth aspect of the present disclosure is the solid fuel burner according to the third or fourth aspect, wherein the first swirler (6) and the second swirler (7) are provided away from an inner wall of the fuel nozzle (9).

An invention of a sixth aspect is the solid fuel burner according to the third or fourth aspect, wherein respective vanes (7*a*) of the second swirler (7) are installed so that an installation angle of the respective vanes (7*a*) of the second swirler (7) with respect to a burner central axis direction is equal to or smaller than the installation angle of the respective vanes (6*a*) of the first swirler (6) with respect to the burner central axis direction.

An invention of a seventh aspect is the solid fuel burner according to the third or fourth aspect, wherein a radial length of the respective vanes (7*a*) of the second swirler (7) is equal to or shorter than the radial length of respective vanes (6*a*) of the first swirler (6).

An invention of an eighth aspect is the solid fuel burner according to the third or fourth aspect, wherein a lateral width of respective vanes (7*a*) of the second swirler (7) is the same as or smaller than the lateral width of respective vanes (6*a*) of the first swirler (6).

An invention of a ninth aspect of the present disclosure is the solid fuel burner according to any one of the first to eighth aspects of the present disclosure, wherein a disperser (14) for solid fuel particles is provided in the curved tube section (5).

An invention of a tenth aspect of the present disclosure is the solid fuel burner according to the ninth aspect of the present disclosure, wherein the disperser (14) is installed on a lateral face of an oil burner (8) provided on the burner central axis on a side facing a flow of the mixed (Action)

In order to improve ignitability of the solid fuel such as pulverized coal, it is necessary to increase a fuel concentration in the vicinity of an outlet edge part of the burner or the flame stabilizer provided therein. By forming a vortex flow by the flame stabilizer; a flame to be a constantly burning pilot light is formed in the vicinity of the flame stabilizer, such that combustion of the fuel is promoted. The vortex flow promotes mixing of the solid fuel with the carrier gas, and is also a flow in the reverse direction, such that it has an action of facilitating the stability of the flame. Then, since it is necessary to set the fuel concentration to a certain value or more in order to ignite the fuel, it is particularly important to increase the fuel concentration in the vicinity of the outlet edge part of the burner and the flame stabilizer at the time of a low load in which the average fuel concentration is low.

The inventors considered increasing the fuel concentration in the vicinity of the flame stabilizer on the outer periphery of the outlet of the fuel nozzle by using a centrifugal effect due to the swirling flow of the mixed fluid. In order to increase the fuel concentration in the vicinity of the flame stabilizer, it is important to move the fuel flowing through the central part of the fuel nozzle to the outer peripheral side. Meanwhile, it is not necessary to move the fuel flowing on the outer peripheral side of the fuel nozzle (in the vicinity of the inner wall of the nozzle).

In the curved tube section at an inlet of the burner of the flow path through which the solid fuel passes, a concentration distribution from a region in which the solid fuel concentration is high to a region in which the solid fuel concentration is low may easily occur by a drift due to a centrifugal force. Therefore, the first swirling means is provided on the burner central axis side downstream of the curved tube section, and the fuel flowing through the central part of the burner is moved in the radial direction (to the outer peripheral side).

Meanwhile, when a strong swirl is applied to the mixed fluid at the outlet of the fuel nozzle, the solid fuel scatters to the outer peripheral side of the burner in the furnace. If this phenomenon occurs, stability of the flame is decreased, and the emission amount of NOx is increased. Accordingly, it is necessary to weaken the swirl strength before the mixed fluid is sprayed into the furnace. Therefore, by providing the second swirling means for applying a swirl in the direction reverse to that of the first swirling means downstream in the flow direction of the mixed fluid of the first swirling means, the swirl strength may be reduced at once.

That is, in accordance with the invention, the mixed fluid having the concentration distribution produced by the curved tube section is moved in the radial direction from the central axis by the first swirling means to increase the fuel concentration in the vicinity of the inner wall, and further the swirl strength may be reduced at once by applying a reverse swirl by the second swirling means. Accordingly, it is not necessary to secure the flow path length of the mixed fluid, and sizes of the fuel nozzle and the burner are not increased. Then, by weakening the swirling force of the mixed fluid, the ignitability in a fuel nozzle outlet is improved, and the stability of the flame is improved.

In addition, also in accordance with the invention, by applying the swirl to the mixed fluid, in which the concentration distribution is produced by the curved tube section, by the first swirler, the fuel concentration in the vicinity of the inner wall is increased, and further by applying the reverse swirl by the second swirler, the swirl strength may be reduced at once. Furthermore, since the first swirler and the second swirler include the plurality of vanes installed in the circumferential direction, respectively, a simple configuration may be obtained, and these swirlers may be easily formed.

Further, in accordance with the inventions, in addition to the actions of the inventions, the ignitability and the stability of the flame are further improved by the flame stabilizer provided in the fuel nozzle outlet, and an effect of improving the stability of the flame is high.

In addition, when applying a reverse swirl by the second swirler to the mixed fluid in which the swirl is applied by the first swirler, the installation angle, the radial length of the respective vanes, the lateral width of the respective vanes, and the like of the respective vanes of the second swirler with respect to the burner central axis direction are set to be different from those of the respective vanes of the first swirler, such that the strength of the swirl may be changed.

When the installation angle of respective vanes of the second swirler is set to be larger than the installation angle of the respective vanes of the first swirler, when the radial length of respective vanes of the second swirler is set to be longer than the radial length of respective vanes of the first swirler, and when the lateral width of the respective vanes of the second swirler is set to be larger than the lateral width of the respective vanes of the first swirler, strong reverse swirls are applied not only to nearer the central axis but also to the mixed fluid on the outer peripheral side.

Therefore, in accordance with the invention, in addition to the action of the invention, the installation angle of the respective vanes of the second swirler is set to be equal to or smaller than the installation angle of the respective vanes of the first swirler, such that it is possible to appropriately maintain the swirl strength in the fuel nozzle outlet without applying the strong reverse swirl to the mixed fluid.

In addition, in accordance with the invention, in addition to the action of the invention, the radial length of the respective vanes of the second swirler is equal to or shorter than the radial length of the respective vanes of the first swirler, such that it is possible to appropriately maintain the swirl strength in the fuel nozzle outlet without applying the strong reverse swirl to the mixed fluid.

Further, in accordance with the invention, in addition to the action of the invention, the lateral width of the respective vanes of the second swirler is equal to or smaller than the lateral width of the respective vanes of the first swirler, such that it is possible to appropriately maintain the swirl strength in the fuel nozzle outlet without applying the strong reverse swirl to the mixed fluid.

Further, since the centrifugal force acts on the mixed fluid by moving the mixed fluid via the curved tube section, the solid fuel after passing through the curved tube section becomes a state of being biased in a direction on which the centrifugal force acts. Therefore, in accordance with the invention, in addition to the action of the invention, by providing the disperser of solid fuel particles in the curved tube section, a bias of the solid fuel particles in the mixed fluid is reduced.

Further, in accordance with the invention, in addition to the action of the invention, the disperser is installed on the lateral face of the oil burner provided on the burner central axis on the side facing the flow of the mixed fluid, such that the mixed fluid flows in the radial direction from the burner central axis in bypass manner after abutting the disperser. Thereby, the solid fuel particles may be dispersed to the outer peripheral side of the fuel nozzle.

Advantageous Effects

The solid fuel burner of the present disclosure may improve the stability of the flame at the time of a low load in which the fuel concentration is low. Specifically, the following effects are obtained.

In accordance with the invention, by increasing the fuel concentration in the vicinity of the inner wall of the fuel nozzle and weakening the swirling force of the mixed fluid at the fuel nozzle outlet, the ignitability and the stability of the flame are improved. Also, the sizes of the fuel nozzle and the burner are not increased.

In addition, in accordance with the invention, by increasing the fuel concentration in the vicinity of the inner wall and weakening the swirling force of the mixed fluid at the fuel nozzle outlet, the ignitability and the stability of the flame are improved. Further, since the first swirler and the second swirler have a simple configuration, these swirlers may be easily installed at a low cost without increasing the size of the burner.

Further, in accordance with the invention, it is possible to prevent the solid fuel from scattering to the outer periphery of the burner, such that the stability of the flame is further improved, and a NOx emission amount is reduced.

Furthermore, in accordance with the invention, the second swirling means (second swirler) is disposed on the upstream side in the direction in which the mixed fluid is carried from the opening of the straight tube section with a preset interval so that the swirl component by the second swirling means does not remain. Therefore, widely scattering of the pulverized coal in the furnace may be minimized, and increasing of the NOx concentration may be minimized.

Further, in accordance with the inventions, in addition to the effects of the inventions, the ignitability and the stability of the flame in the fuel nozzle outlet are further improved by the flame stabilizer, and the effect of improving the stability of the flame is further enhanced.

In accordance with the inventions, in addition to the effect of the invention, the swirl strength may be appropriately maintained in the fuel nozzle outlet, and the ignitability and the stability of the flame are improved.

In accordance with the invention, in addition to the effect of the invention according to any one of the first to eighth aspects, the bias of the solid fuel particles is reduced by the disperser, such that the swirl effect on the downstream side may be more enhanced than ever before.

In accordance with the invention, in addition to the effect of the invention, the mixed fluid flows in the radial direction from the burner central axis and further in the circumferential direction by the disperser, such that the solid fuel particles are dispersed on the outer peripheral side of the fuel nozzle, and thereby stable combustion in the solid fuel burner may be achieved.

DESCRIPTION OF EMBODIMENTS

Hereinafter, embodiments of the present disclosure will be described.

Figure 1:
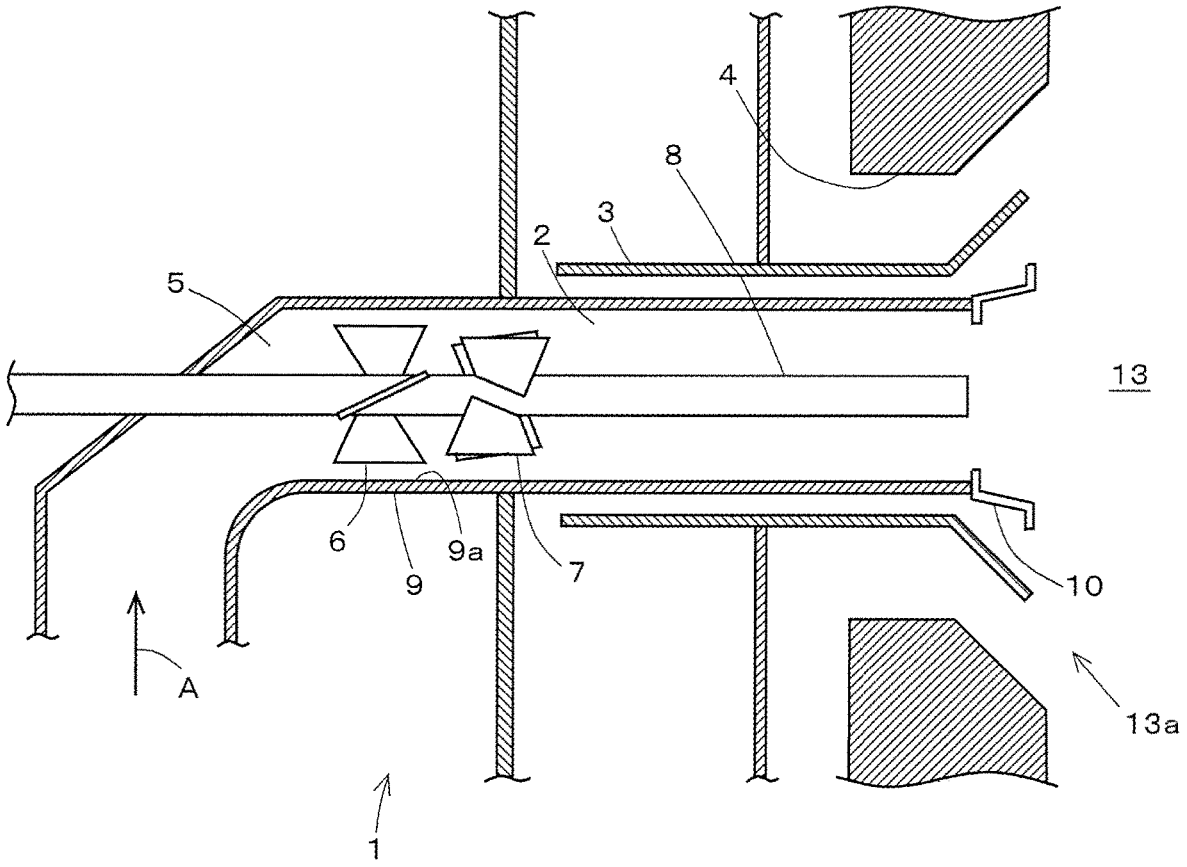
FIG. 1 is a side view illustrating a partial cross-section of a solid fuel burner which is one example (Example 1) of the present disclosure.

FIG. 1 is a side view (schematic view) illustrating a partial cross-section of a solid fuel burner according to one example of the present disclosure.

A solid fuel burner 1 provided in a throat 13*a* of a wall surface of a furnace 13 has a curved tube section 5 having a curved section of about 90° and a straight tube section 2 continued to the curved tube section 5, and includes a nozzle 9 having a circular cross-section for supplying a fuel, through which a mixed fluid of a finely powdered fuel and a carrier gas (solid-gas two-phase flow) flows. An oil burner 8 is provided on a central axis of the straight tube section 2.

Further, as the solid fuel, coal, biomass, or a mixture thereof may be used. In addition, as the carrier gas of the solid fuel, air is commonly used, but a mixed gas of a combustion exhaust gas and air may also be employed, and any type of the fuel and carrier gas may be used. In the present embodiment, an example, in which pulverized coal is used as the solid fuel and air is used as the carrier gas, is illustrated, and the nozzle 9 for supplying a fuel is also referred to as a primary air nozzle 9.

A tip of the straight tube section 2 is opened toward the furnace 13, and a mixed fluid of pulverized coal and the primary air supplied from a direction of an arrow A (lower side) to the primary air nozzle 9 passes through the curved tube section 5, and a direction thereof is changed by about 90°, then flows from the straight tube section 2 toward the furnace 13 and is sprayed from the opening (an outlet of the primary air nozzle 9). The curved tube section 5 may have a vertical cross-sectional shape of an L shape or a U shape, and may have a plurality of corners as illustrated in the drawing. In addition, an, angle of the curved section of the curved tube section 5 is not limited to 90°, and it may be larger or smaller than 90°. As the curved tube section 5, an elbow pipe, a bend pipe or the like may be used.

Further, a secondary air nozzle 3 and a tertiary air nozzle 4 are disposed in a concentric pattern around the primary air nozzle 9, and secondary air and tertiary air are supplied toward the furnace 13. These air streams are sprayed so as to spread in an outer peripheral direction. Further, a flame stabilizer (flame stabilization ring) 10 having an end-widening shape (conical) toward the furnace 13 side is provided around the outlet of the primary air nozzle 9 and between the primary air nozzle 9 and the secondary air nozzle 3. Further, a burner with no flame stabilizer 10 installed therein is also included in the present embodiment A circulation flow is formed on a downstream side (the furnace 13 side) of the flame stabilizer 10, and a mixture of the fuel and air sprayed from the primary air nozzle 9, the secondary air, a high-temperature combustion gas and the like flows into the circulation flow and remains therein. In addition, a temperature of the fuel particles rises due to radiant heat received from the furnace 13. With these effects, the solid fuel ignites on the downstream side of the flame stabilizer 10, and the flame is maintained. An oil fuel is supplied from the tip of the oil burner 8 installed on the central axis of the primary air nozzle 9. The oil fuel is used to start up the solid fuel burner 1.

In addition, a supplied to the secondary air nozzle 3 and the tertiary air nozzle 4 may be adjusted and controlled with a flow rate and a flow velocity of air by a flow rate adjustment member (such as a damper, air register, or the like) (not illustrated).

In order to improve ignitability of the pulverized coal, it is necessary to increase a fuel concentration in the vicinity of the flame stabilizer 10 at the burner outlet. Since the pulverized coal concentration is required to be set to a certain value or more when igniting the pulverized coal, it is particularly important to increase the fuel concentration in the vicinity of the flame stabilizer 10 at the time of a low load in which an average concentration of the pulverized coal is low.

Therefore, by applying a swirl to the mixed fluid, it becomes possible to increase the fuel concentration in the vicinity of the flame stabilizer 10 due to its centrifugal effect. For that purpose, it is important to move the pulverized coal flowing around the oil burner 8 at the central part of the primary air nozzle 9 (on the central axis side of the cylindrical nozzle cross-section) to an outer peripheral side (radially outside, in the vicinity of the inner wall 9*a*). Meanwhile, there is no need to move the pulverized coal flowing in the vicinity of the inner wall 9*a* of the primary air nozzle 9.

Therefore, a first swirler 6 is provided at an entrance portion of the straight tube section 2 immediately after the curved tube section and the central part of the primary air nozzle 9, and the pulverized coal flowing through the central part of the primary an nozzle 9 is moved to the outer peripheral side. The first swirler 6 includes a plurality of plate-shaped vanes 6*a* attached to an outer periphery of the oil burner 8. Further, in the region immediately after passing through the curved tube section 5, there is no need to apply a swirl to the mixed fluid flowing in the vicinity of the inner wall 9*a* of the primary air nozzle 9, such that an end part of the vane 6*a* is installed away from the inner wall 9*a*.

If the swirl is strongly applied to the mixed fluid at the outlet of the primary air nozzle 9, the pulverized coal particles splatter to the outer peripheral side of the solid fuel burner 1 within the furnace 13, such that stability of the flame is decreased, and a NOx emission amount is increased as described above. Accordingly, it is necessary to weaken the swirl strength before the mixed fluid is sprayed into the furnace 13. In the present embodiment, as a second swirler 7 on the downstream side of the first swirler 6, similar to the first swirler 6, a plurality of plate-shaped vanes 7*a* are attached to the outer periphery of the oil burner 8. These swirlers 6 and 7 are a fixed type swirl in which each vane does not move.

Figure 2:
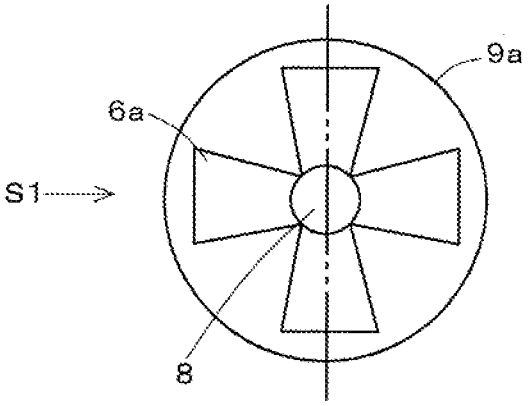
FIG. 2(A) is a front view of a first swirler in FIG. 1 (view seen from a furnace side)
FIG. 2(B) is a view seen from S1 in FIG. 2(A)
FIG. 2(C) is a front view of a second swirler in FIG. 1.
FIG. 2(D) is a view seen from 82 in FIG. 2(C).
Figure 2:
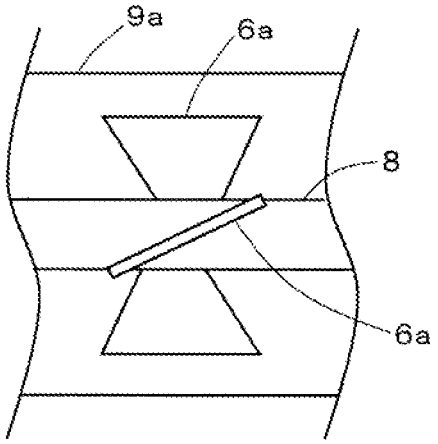
Figure 2:
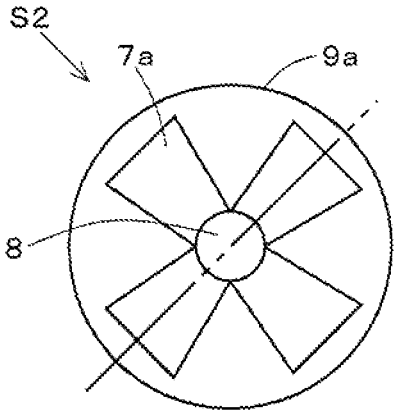
Figure 2:
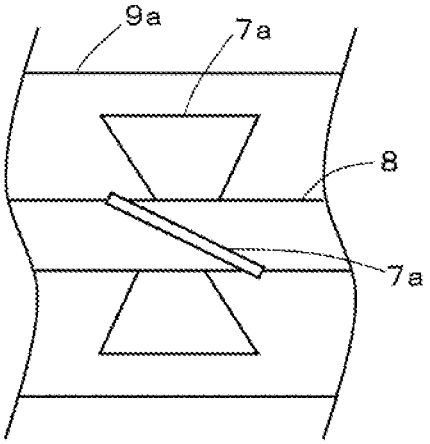

FIG. 2 illustrates diagrams of the first swirler and the second swirler in FIG. 1. FIGS. 2(A) and 2(C) illustrate front views, respectively, FIG. 2(B) illustrates a view seen from S1 in FIG. 2(A), and FIG. 2(D) illustrates a view seen from S2 in FIG. 2(C). Further, in order to reduce the number of particles that can pass through the swirlers 6 and 7 without colliding with the swirlers 6 and 7, when viewing from the furnace 13, the respective swirlers 6 and 7 are installed so that the respective vanes 6*a* and 7*a* are not overlapped with each other as illustrated in FIGS. 2(A) and 2(C), but it is not particularly limited to this arrangement.

As illustrated in FIG. 2, the direction of the vanes 7*a* of the second swirler 7 is reversed to the direction of the vanes 6*a* of the first swirler 6, such that the swirl strength of the mixed fluid at the outlet of the primary air nozzle 9 is weakened.

In the example of FIG. 1, the directions of the vanes 6*a* and the vanes 7*a* (the direction of the swirl around the central axis) are reverse to each other, but the shapes and sizes of the respective vanes 6*a* and 7*a* are set to be all the same, and installation angles thereof with respect to the burner central axis direction of the respective vanes 6*a* and 7*a* are set to be the same as each other. Further, in the illustrated example, the number of the respective vanes 6*a* and 7*a* is set to be four by four, but it may be larger or smaller than four, and it may be appropriately changed according to the size of the burner 1. In addition, although it is not always necessary to equally provide the respective vanes 6*a* and 7*a* in the circumferential direction, by making them be equal, it is possible to prevent a strong swirl from being applied to only a part of them.

Further, if the directions of the vanes 6*a* and the vanes 7*a* are reverse to each other, the shapes, sizes, installation angles, and the like of the vanes 6*a* and vanes 7*a* may be different from each other. In addition, both the vanes 6*a* and the vanes 7*a* are not necessarily provided on the burner central axis, and may contact the inner wall 9*a*, but for the following reasons, it is preferable to provide these vanes on the burner central axis or install them away from the inner wall 9*a*.

As the mixed fluid passes through the curved tube section 5, concentration distributions occur in the circumferential direction and the radial direction of the cylindrical nozzle cross-section. Then, the flow passing through a void between the vanes 6*a* of the first swirler 6 and the inner wall 9*a* among the mixed fluids, in which the concentration distribution has occurred, becomes a flow in such a manner that the concentration distribution produced in the circumferential direction is maintained toward the nozzle outlet.

Meanwhile, the mixed fluid flowing on the central axis side becomes a flow which is expanded toward the radial outside of the cylindrical nozzle cross-section on the downstream side thereof by the vanes 6*a* of the first swirler 6, so that the pulverized coal is condensed to the inner wall 9*a* side.

For this reason, as a result of overlapping the above two flows with each other, the mixed fluid flowing in the vicinity of the inner wall 9*a* is subjected to some stirring effect by swirling, but it exhibits a tendency in which the concentration distribution produced in the circumferential direction is maintained toward the nozzle outlet, and further the pulverized coal concentration is increased.

Herein, on the downstream side of the second swirler 7, due to the action of the vanes 7*a*, the swirling flow is weakened (or disappears) when viewing the cylindrical nozzle cross-section as a whole, but the pulverized coal concentration of the mixed fluid flowing in the vicinity of the nozzle inner wall 9*a* exhibits a tendency of being maintained to the nozzle outlet part (end edge part) due to an inertial force acting in the flowing direction of the pulverized coal particles.

As illustrated in FIG. 2, by installing the vanes 6*a* and the vanes 7*a* away from the inner wall 9*a*, the mixed fluid flowing between the end parts of the respective vanes 6*a* and 7*a* and the inner wall 9*a* becomes a flow so as to be maintained toward the nozzle outlet, such that a high fuel concentration in the vicinity of the inner wall 9*a* may be maintained.

Although the radial lengths of the respective vanes 6*a* and 7*a* are not particularly limited, it is desirable that the diameters of the vanes are set to be 50 to 75% of the inner diameter of the primary air nozzle 9. If the diameters of the respective vanes 6*a* and 7*a* are larger than 75%, the swirling component may easily remain in the fluid flowing on the outer peripheral side of the primary air nozzle 9. Further, if the diameters of the respective vanes 6*a* and 7*a* are too large, it is difficult to install and remove these vanes, and maintainability is deteriorated. Meanwhile, if the diameters of the respective vanes 6*a* and 7*a* are smaller than 50%, a concentration of particles to the outer peripheral side of the primary air nozzle 9 is insufficient.

FIG. 3(A) illustrates the particle concentration distribution in the radial direction of the burner 1 in FIG. 1, and FIG. 3(B) illustrates the particle concentration distribution in the radial direction of the burner used as a comparison. A fluid analysis by a k-ε model was performed under a condition that the air and the pulverized coal flow at a rated load condition amount of the burner from the direction of an arrow A in FIG. 1, and the concentration distribution of the pulverized coal particles at the outlet of the primary air nozzle 9 was calculated.

Further, the burner used as the comparison has a structure in which the swirler is not installed at all and the swirlers 6 and 7 are removed from the burner having the structure of FIG. 1. An origin of the horizontal axis in each drawing is the central axis of the primary air nozzle 9, that is, an installation part of the oil burner 8, and it illustrates approaching the nozzle inner wall 9*a* with increasing the radial distance. That is, it illustrates that the distance in the radial direction from the central axis becomes larger according to the direction of the arrow (right direction) on the horizontal axis. The scales of the respective axes in FIGS. 3(A) and 3(B) are the same as each other. The pulverized coal concentration is an average in the circumferential direction of the concentration measured at a position where the radial distances are, the same as each other. It illustrates that the concentration becomes higher according to the direction of the arrow (upper direction) on the vertical axis. It can also be seen from FIG. 3(A) that the pulverized coal concentration in the vicinity of the inner wall 9*a* is increased due to a swirling action by the first swirler 6 and the second swirler 7.

Figure 21:
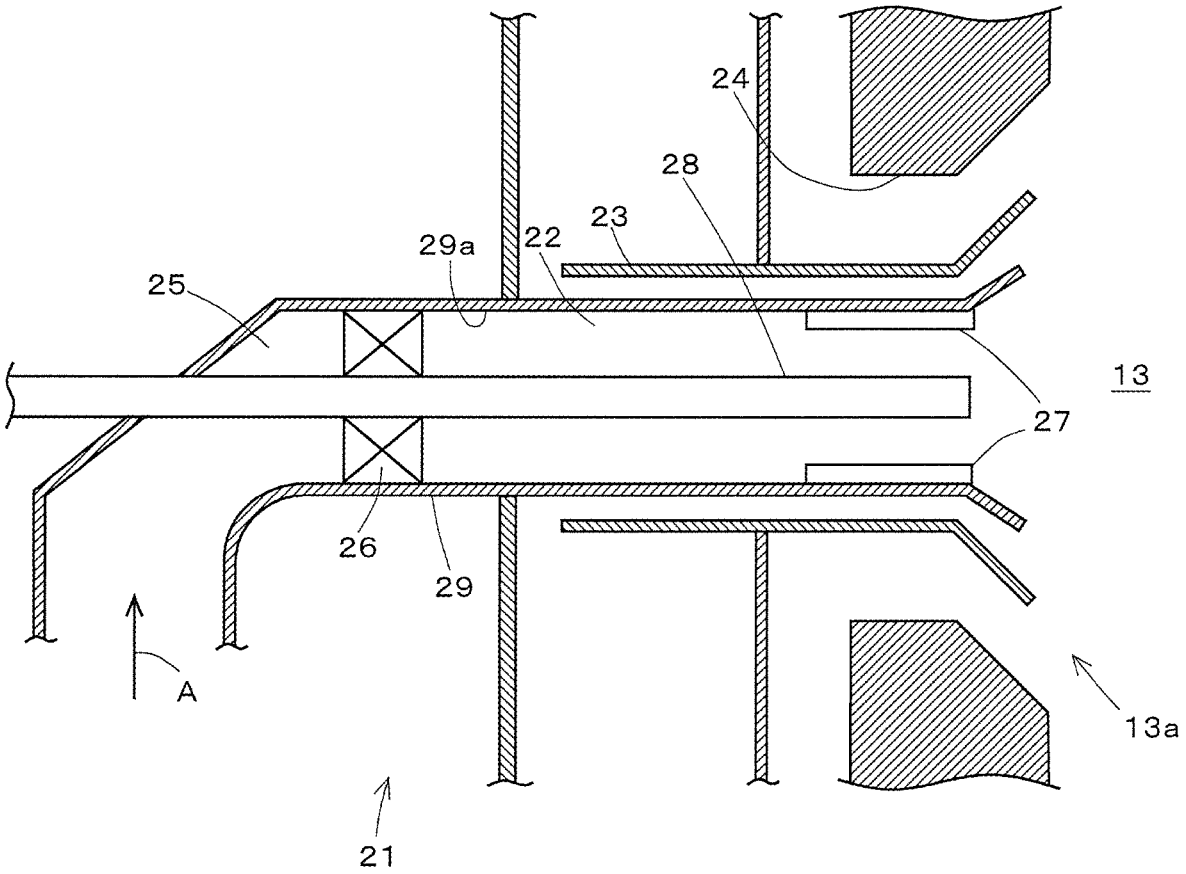
FIG. 21 is a side view illustrating a partial cross-section of a conventional solid fuel burner.

In order to compare with the burner 21 of FIG. 21, the effect of the present example was further verified.

The burner 21 of FIG. 21 is identical to the burner 1 of FIG. 1 in that the swirl vane 26 is provided in the pulverized coal supply pipe 29. In addition, a straightening plate 27 is installed at the burner outlet in order to weaken the swirling force. However, in the burner 21 of FIG. 21, the swirl vane 26 is attached in contact with the inner wall 29*a* of the pulverized coal supply pipe 29, and there is no void between the swirl vane 26 and the inner wall 29*a*. Similarly, the straightening plate 27 is attached to the inner wall 29*a*, and is installed away from the central axis.

Figure 3:
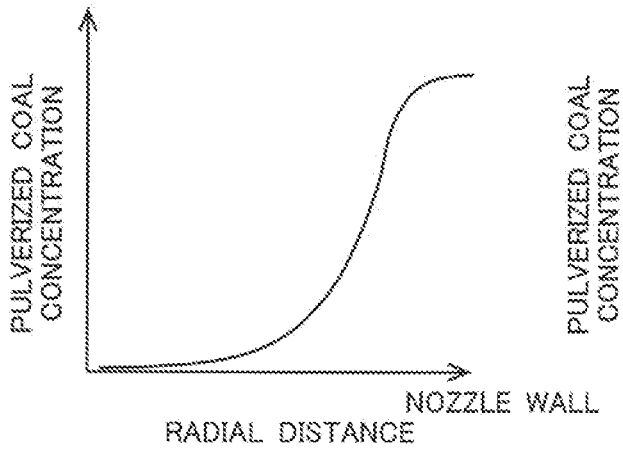
FIG. 3(A) is a diagram illustrating a particle concentration distribution in a radial direction of the burner of Example 1.
FIG. 3(B) is a diagram illustrating the particle concentration distribution in the radial direction of a burner used as a comparison.
Figure 3:
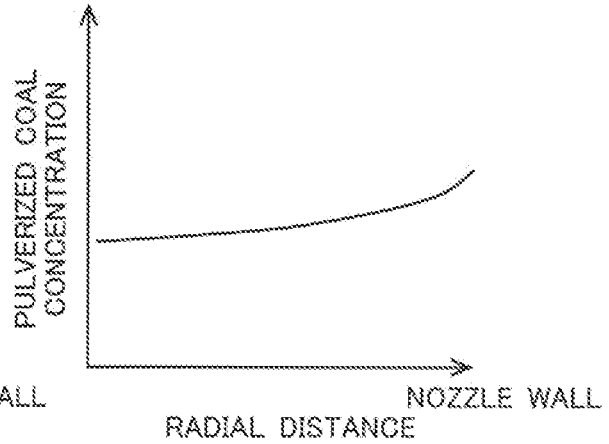
Figure 4:
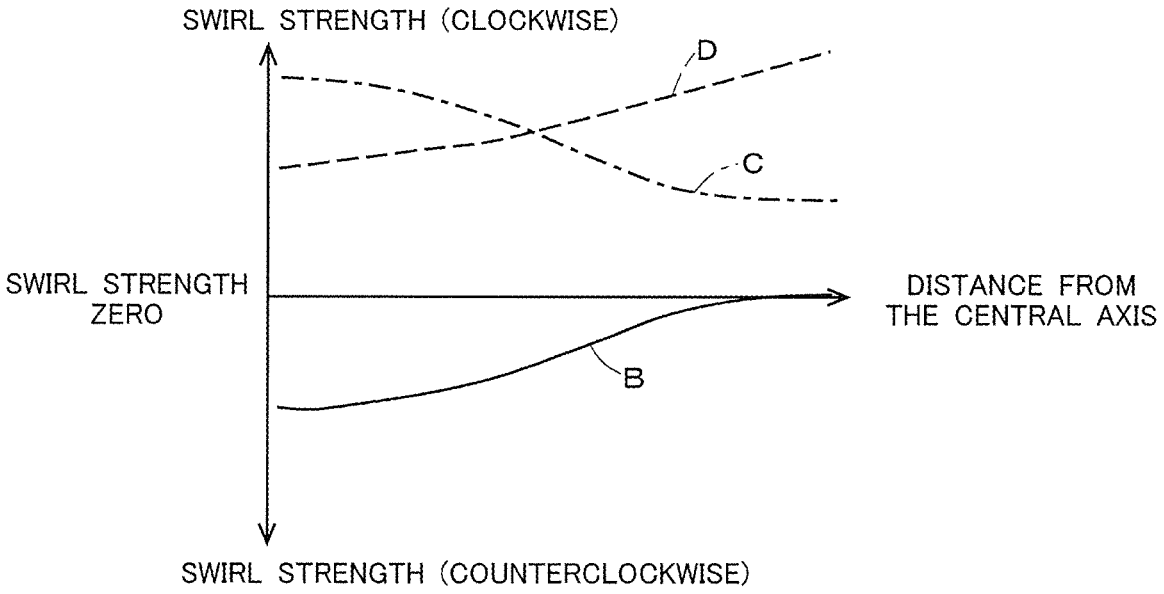
FIG. 4 is a diagram illustrating swirl strength distributions in the vicinity of burner outlets of the burner of Example 1 and the burner of the comparative example.

FIG. 4 illustrates swirl strength distributions in the vicinity of the burner outlets of the burner 1 in FIG. 1 and the burner of the comparative example. The fluid analysis by the k-ε model was executed under a condition that the air and the pulverized coal flow at a rated load condition amount of the burner 1 and with a burner having the same structure as the burner of FIG. 1, but with varied swirler shape and installation method, from the direction of the arrow A in FIG. 1, similar to the case of FIG. 3. Then, the swirl strength distribution of the air at the burner outlet crass-section in the primary air nozzle 9 was calculated. In this fluid analysis, numerical values of both the concentration distribution of the pulverized coal and the swirl strength distribution are calculated.

The origin of FIG. 4 is the central axis of the primary air nozzle 9 (the installation part of the oil burner 8). The horizontal axis illustrates a radial distance from the central axis, and it illustrates approaching the inner wall 9*a* with increasing the radial distance. In the present specification, the swirl strength refers to a circumferential average value of the swirl strengths (a flow velocity component in a swirl direction (circumferential direction) to a flow velocity component in a main current direction (axial direction)), which are measured at the same radial distance as each other.

Since there are clockwise and counterclockwise in the swirl direction as viewed from the furnace 13, two axes (vertical axis) are illustrated in FIG. 4 so that the direction of swirl may be determined.

A solid line B illustrates the swirl strength distribution of the burner 1 (in which the first swirler (and the second swirler 7 are installed away from the inner wall 9*a*) of FIG. 1, a one-dot, chain line C illustrates the swirl strength distribution of a case in which there is no second swirler 7 of the burner 1 of FIG. 1 (wherein the first swirler 6 is provided with being installed away from the inner wall 9*a* (Comparative Example 1), and a broken D illustrates the swirl strength distribution of a case in which the second swirler 7 of the burner 1 of FIG. 1 is not provided and the first swirler 6 is installed in contact with the inner wall 9*a* (Comparative Example 2).

In Comparative Example 1 (one-dot chain line C), the swirl strength of the primary air nozzle 9 at the central part (origin side) was strong, but the swirl strength on the outer peripheral side of the primary air nozzle 9 was weakened. The reason is that the vanes 6*a* of the first swirler 6 are installed only in the central part of the primary air nozzle 9. However, it can be said that the swirl strength thereof on the outer peripheral side is comparatively strong.

Meanwhile, in a case in which two swirlers 6 and 7 of the example (solid line B) are attached so that the directions of the vanes 6*a* and 7*a* are reversed to each other, a swirl was applied to the central part, but the swirl was not applied to the outer peripheral side. Since the swirl is applied to the central part, the mixed fluid flowing through the central part of the primary air nozzle 9 moves to the outer peripheral side.

Thereby, the particle concentration in the vicinity of the flame stabilizer 10 of the primary air nozzle 9 is increased. In addition, since swirl is not applied to the outer peripheral side of the primary air nozzle 9, the pulverized coal particles moved to the outer peripheral side do not scatter to the outer periphery of the burner in the furnace 13.

On the other hand, in Comparative Example 2 (broken line D), a strong swirl is applied to the outer peripheral side of the primary air nozzle 9. Since the swirl is also applied to the central part of the primary air nozzle 9, there is an effect of increasing the particle concentration in the vicinity of the flame stabilizer 10 of the primary air nozzle 9. However, since the swirl strength on the outer peripheral side of the primary air nozzle 9 is strong, it becomes difficult to adjust the swirl strength at the burner outlet. Accordingly, also in the burner 21 illustrated in FIG. 21, since the swirl vane 26 and the straightening plate 27 are in contact with the inner wall 29*a* of the pulverized coal supply pipe 29, it can be said that the same problem occurs.

Figure 5:
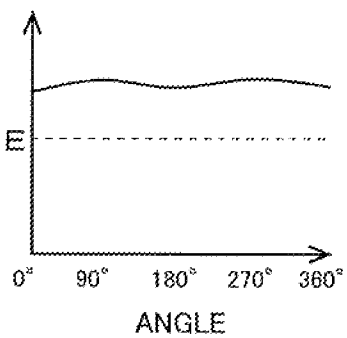
FIG. 5 (A)-5 (C) are diagrams comparing circumferential concentration distributions on outlet outer peripheral sides of the burner of Example 1 and the burner of the comparative example at the time of a high load.
Figure 5:
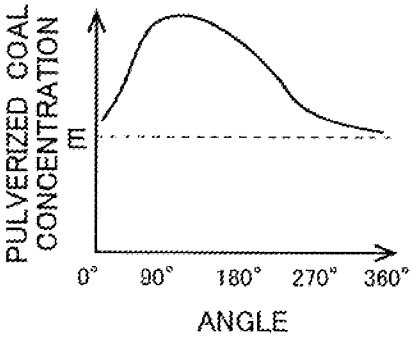
Figure 5:
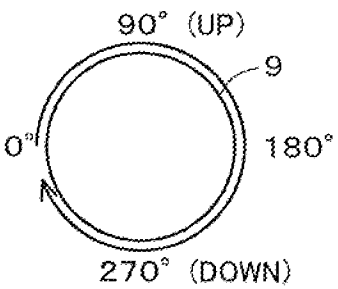
Figure 6:
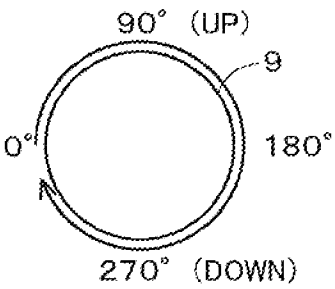
FIG. 6(A)-(6)C are diagrams comparing the circumferential concentration distributions on the outlet outer peripheral sides of the burner of Example 1 and the burner of the comparative example at the time of a low load.
Figure 6:
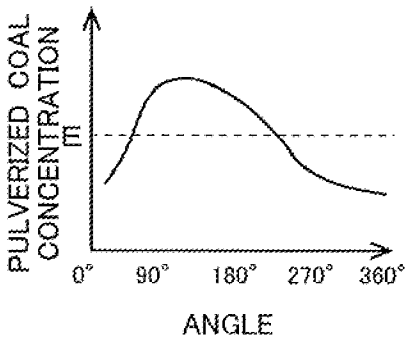
Figure 6:
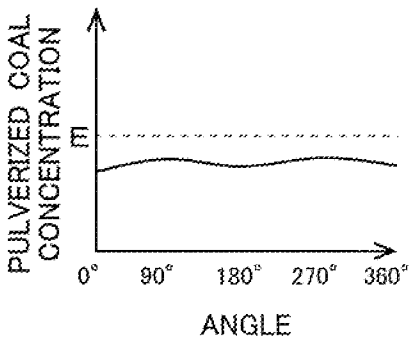

Next, the concentration distribution of the pulverized coal is calculated, then the effect of the present example is further verified, and the results thereof are illustrated in FIGS. 5 and 6. FIG. 5 illustrates the concentration distribution at the time of a high load in which the average concentration of pulverized coal is high, and FIG. 6 illustrates the concentration distribution at the time of a low load in which the average concentration of pulverized coal is low. As illustrated in FIGS. 5(A) and 6(A), the concentration distribution of the pulverized coal on the outermost peripheral side of the primary air nozzle 9 is illustrated along the circumferential direction. By setting the position on the left side to be 0°, the concentration was measured clockwise as viewed from the furnace 13, and the position was represented by an angle. FIGS. 5B and 6B illustrate the concentration distribution of the pulverized coal in the burner 1 of FIG. 1, and FIGS. 5C and 6C illustrate the concentration distribution of the pulverized coal in the burner of the comparative example 2. It illustrates that the concentration of the pulverized coal on the vertical axis becomes higher according to the direction of the arrow (upper direction).

The concentration distributions of the pulverized coal under the rated load condition amount of the burner of FIG. 1 and the burner of the comparative example 2 were calculated using the fluid analysis by the k-ε model similar to the case of FIG. 3.

In these burners, since the pulverized coal is concentrated due to a centrifugal effect at the curved tube section 5, there is tendency of easily increasing the pulverized coal concentration on the upper side (outside the curved section).

In the case of Comparative Example 2, the particle concentration is substantially equal over the entire circumference. That is, since the vanes 6*a* of the first swirler 6 are in contact with the inner wall 9*a*, the swirling strength on the outer peripheral side of the primary air nozzle 9 is strong, and the pulverized coal on the outer peripheral side is agitated to be a uniform concentration. Accordingly, as illustrated in FIGS. 5(C) and 6(C), there is no concentration change in the circumferential direction. Meanwhile, in the burner 1 of FIG. 1, since the swirling force at the central part of the primary air nozzle 9 is strong, but swirl is not adequately applied to the outer peripheral part, the pulverized coal on the outer peripheral side is not agitated much. Therefore, in terms of the concentration distribution in the circumferential direction, there occurs portions with high and low pulverized coal concentrations, respectively.

FIGS. 5 and 6 also illustrate an ignition lower limit concentration E. In order to achieve stable combustion in the burner, it is necessary for at least a part of the pulverized coal concentration to exceed the ignition lower limit concentration E. When there is a place where the pulverized coal concentration exceeds the ignition lower limit concentration E, a flame is formed at the place, and the flame propagates around the place. Under conditions in which the load is high and the average pulverized coal concentration is also high, as illustrated in FIGS. 5(B) and 5(C), both of the pulverized coal concentrations exceed the ignition lower limit concentration E, and there is no difference therebetween.

When the load is low and the average pulverized coal concentration is also low, in Comparative Example 2, as illustrated in FIG. 6(C), there is no place where the pulverized coal concentration is locally high, and the pulverized coal concentration in all regions becomes below the lower limit concentration E, such that stable combustion is not achieved. Further, it is not necessary for the pulverized coal concentration to exceed the ignition lower limit concentration E in all positions, and as illustrated in FIG. 6(B), there is a region in which the pulverized coal concentration is locally high. If the concentration exceeds the ignition lower limit concentration E, it is possible to achieve the stable combustion even under a low load condition.

From the above description, according to the present example, the mixed fluid having the concentration distribution produced by the curved tube section 5 is moved outward in the radial direction from the central part by the first swirler 6 to increase the fuel concentration in the vicinity of the inner wall 9*a*, and a reverse swirl is applied thereto by the second swirler 7, such that the swirl strength may be reduced at once. Accordingly, even in the burner 1 without the flame stabilizer 10, if it is in the state that the fuel concentration in the vicinity of the inner wall 9*a* is high and the swirl strength is reduced, ignitability of the outlet of the primary air nozzle 9 is improved. In addition, it is not necessary to secure the flow path length of the mixed fluid, and the sizes of the primary air nozzle 9 and the burner 1 are not increased.

Further, by providing the flame stabilizer 10 in the outlet of the primary air nozzle 9, the ignitability and the stability of the flame are further improved, and effects of improving the stability of the flame and reducing the NOx emission amount are further enhanced. In addition, the first swirler 6 and the second swirler 7 may be easily formed with a simple configuration that the respective vanes 6*a* and 7*a* are attached to the outer periphery of the oil burner 8. Further, by attaching the vanes 6*a* and 7*a* away from the inner wall 9*a*, the effect of improving the stability of the flame is also enhanced and stable combustion mast be achieved. Furthermore, it is easy to install and remove the vanes 6*a* and 7*a*, and the maintainability is enhanced.

EXAMPLE 2

Figure 7:
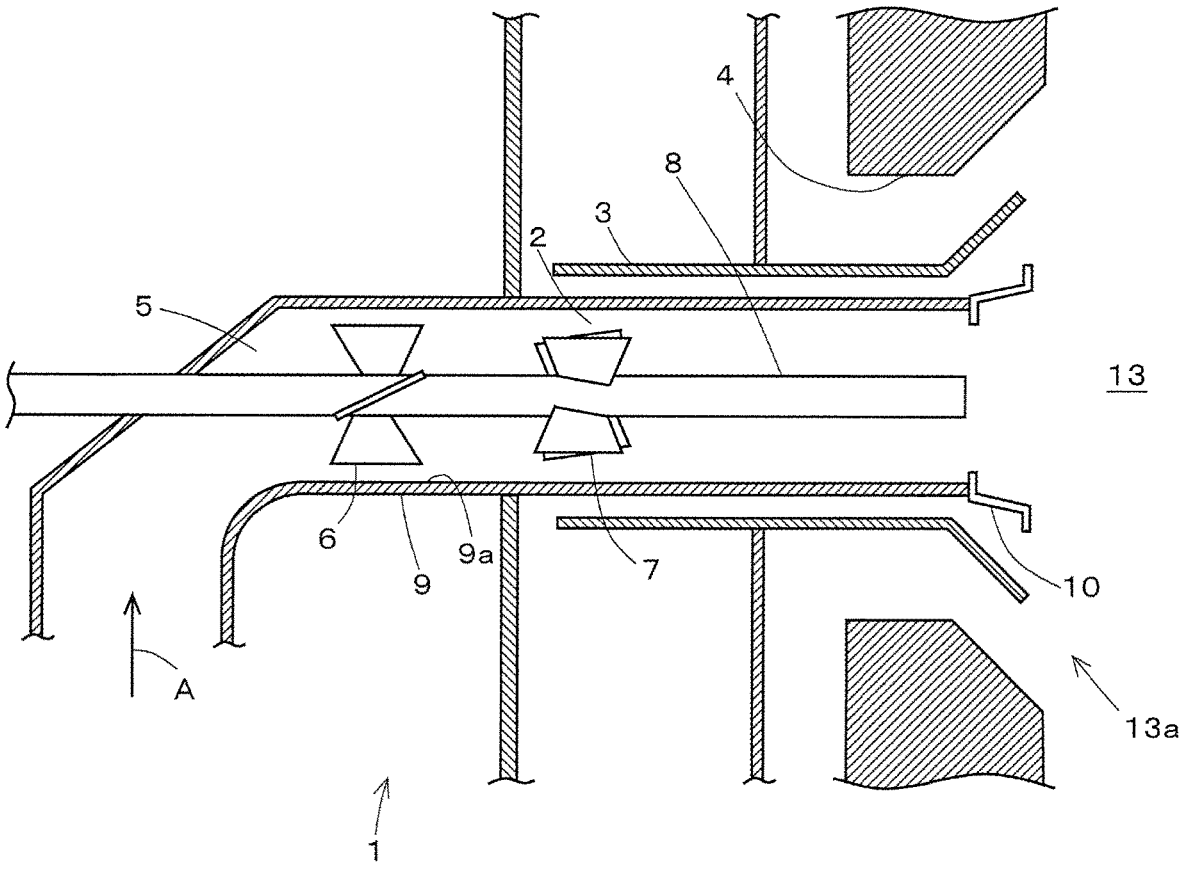
FIG. 7 is a side view illustrating a partial cross-section of a solid fuel burner which is another example (Example 2) of the present disclosure.
Figure 8:
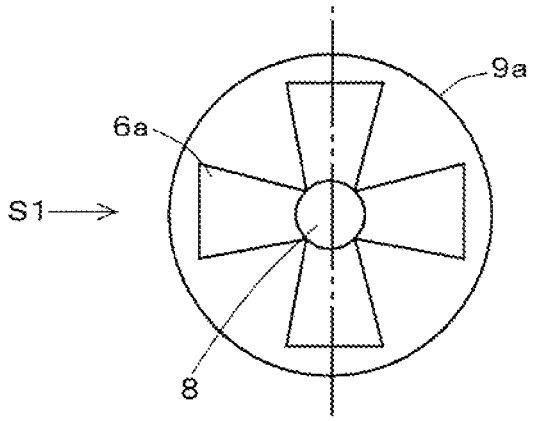
FIG. 8(A) is a front view of a first swirler in FIG. 7.
FIG. 8(B) is a view seen from S1 in FIG. 8(A)
FIG. 8(C) is a front view of a second swirler iii FIG. 7.
FIG. 8(D) is a view seen from S2 in FIG. 8(C).
Figure 8:
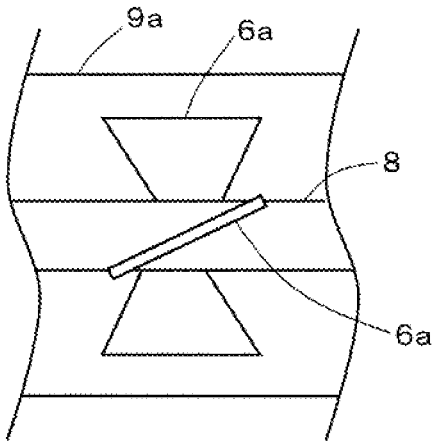
Figure 8:
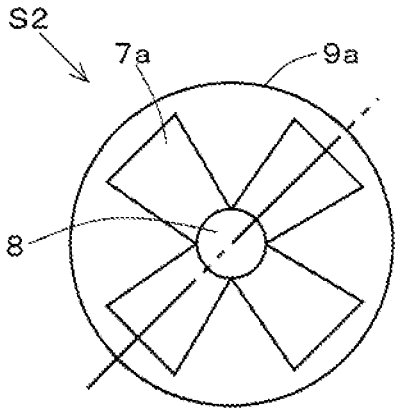
Figure 8:
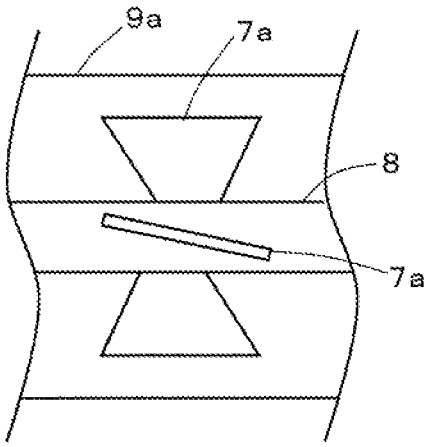

FIG. 7 is a side view (schematic view) illustrating a partial cross-section of a solid fuel burner 1 according to another example of the present disclosure. FIG. 8 illustrates a first swirler and a second swirler in FIG. 7, wherein FIGS. 8(A) and 8(C) are front views, respectively, FIG. 8(B) is a view seen from S1 in FIG. 8(A), and FIG. 8(D) is a view seen from 82 in FIG. 8(C).

In the present example, the installation angle of the vanes 7*a* of the second swirler 7 with respect to the burner central axis direction is smaller than the installation angle of the vanes 6*a* of the first swirler 6, and the other configurations are the same as those of the solid fuel burner 1 according to Example 1. As such, even if the installation angle of the vanes 7*a* of the second swirler 7 and the installation angle of the vanes 6*a* of the first swirler 6 are changed, the same effects as those of Example 1 are obtained.

Further, since there is no particular limitation on the positions of the axial direction of the first swirler 6 and the second swirler 7, various examples are illustrated. In particular, there is no difference in action and effect. These are the same as the other examples.

EXAMPLE 3

Figure 9:
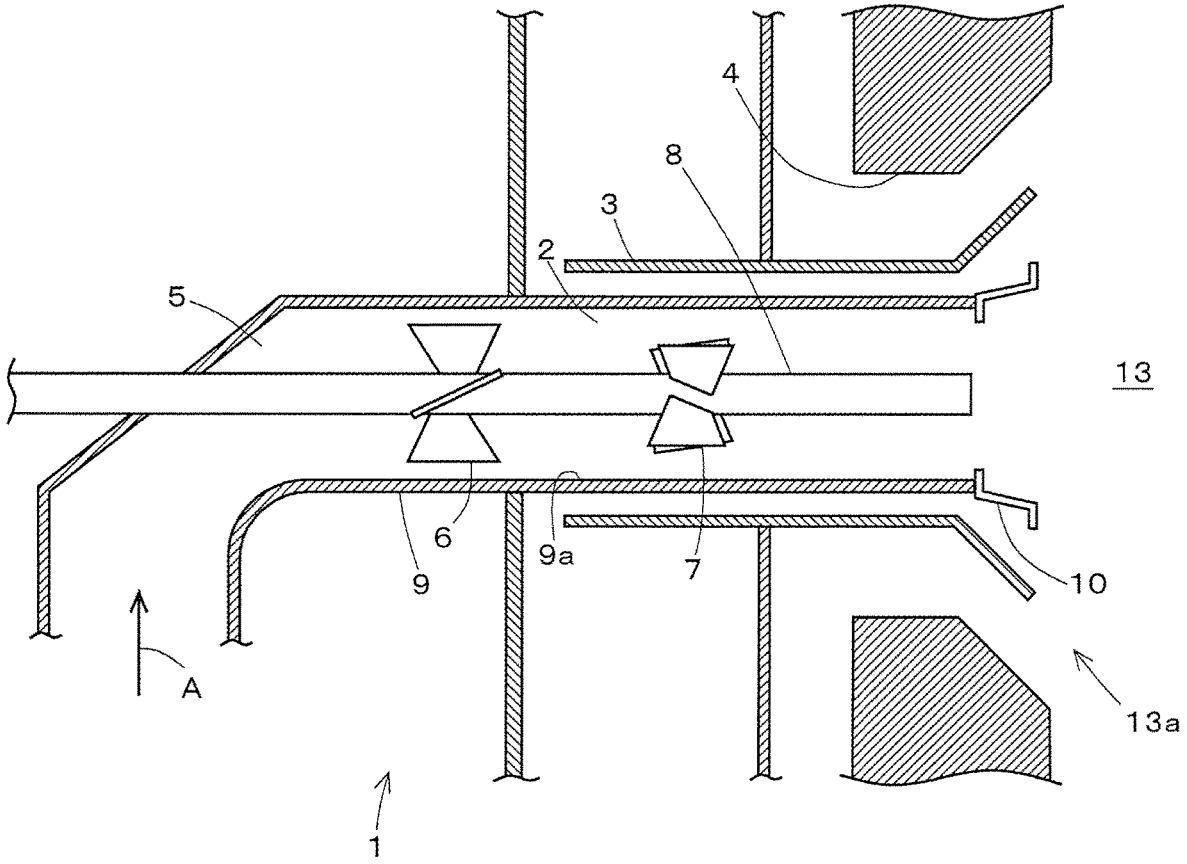
FIG. 9 is a side view illustrating a partial cross-section of a solid fuel burner which is another example (Example 3) of the present disclosure.
Figure 10:
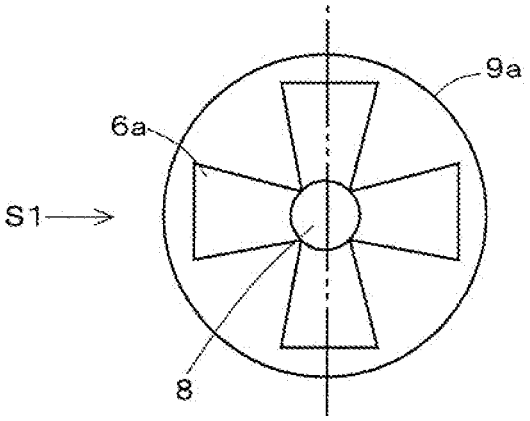
FIG. 10(A) is a front view of a first swirler in FIG. 9.
FIG. 10(B) is a view seen from S1 in FIG. 10(A)
FIG. 10(C) is a front view of a second swirler in FIG. 9.
FIG. 10(D) is a view seen from S2 in FIG. 10(C).
Figure 10:
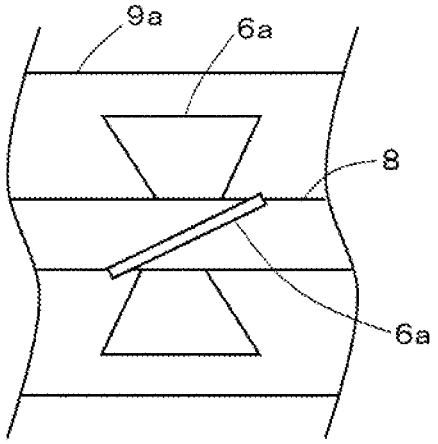
Figure 10:
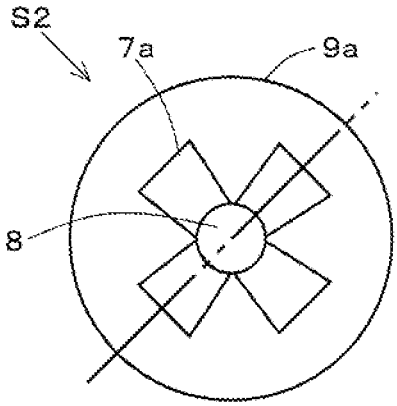
Figure 10:
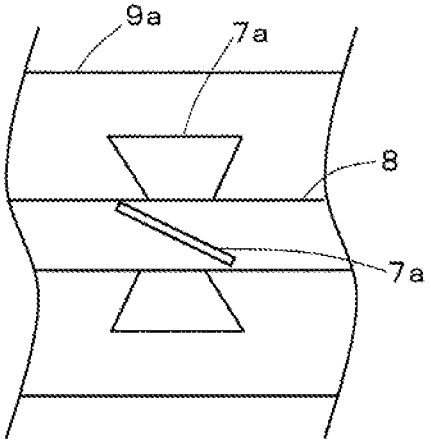

FIG. 9 is a side view (schematic view) illustrating a partial cross-section of a solid fuel burner 1 according to another example of the present disclosure. FIG. 10 illustrates a first swirler and a second swirler in FIG. 9, wherein FIGS. 10(A) and 10(C) are front views, respectively, FIG. 10(B) is a view seen from S1 in FIG. 10(A), and FIG. 10(D) is a view seen from S2 in FIG. 10(C).

In the present example, the radial length of the vanes 7*a* of the second swirler 7 is set to be shorter than the radial length of the vanes 6*a* of the first swirler 6, thus to decrease the size as a whole. The other configurations are the same as those of the solid fuel burner 1 according to Example 1. Therefore, the installation angle and the shape of the vanes 6*a* and the vanes 7*a* are the same as those of Example 1. As such, even if the radial length of the vanes 7*a* of the second swirler 7 and the radial length of the vanes 6*a* of the first swirler 6 are changed, the same effects as those of Example 1 may be obtained.

EXAMPLE 4

Figure 11:
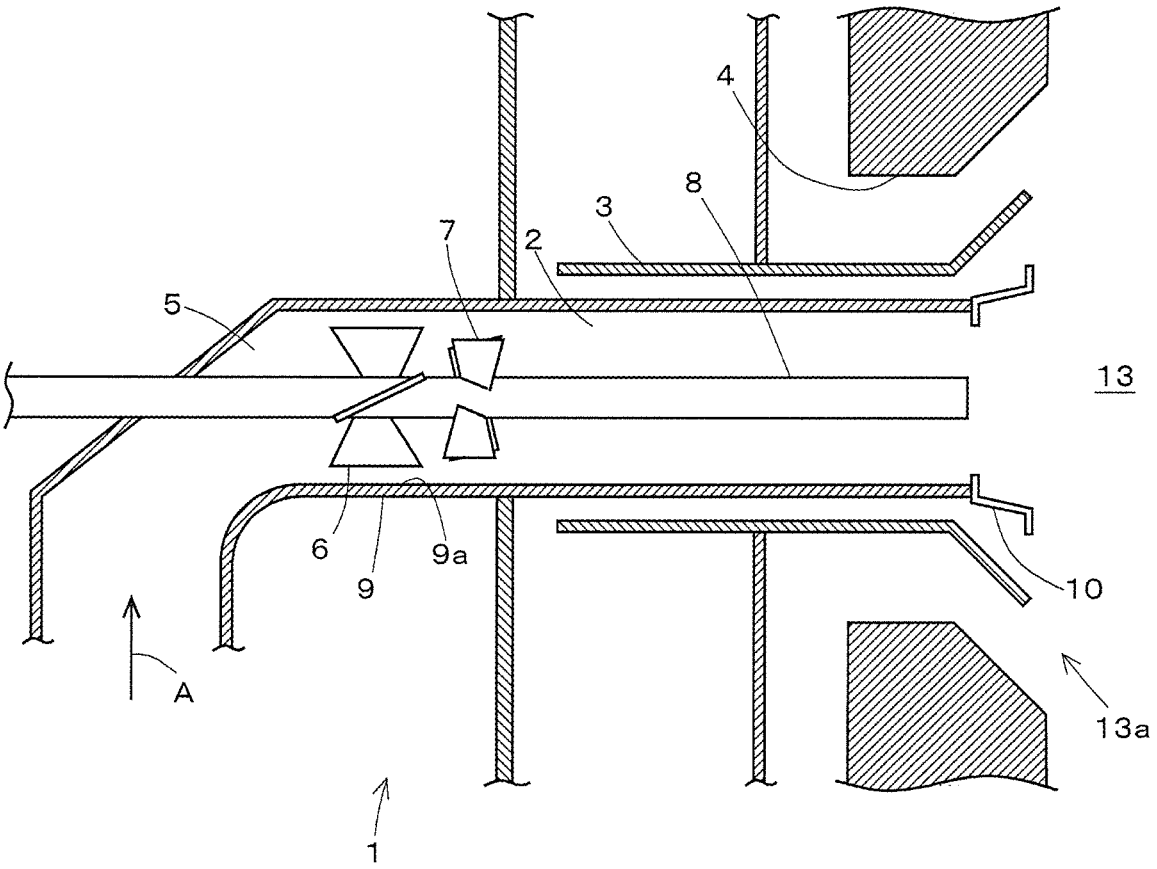
FIG. 11 is a side view illustrating a partial cross-section of a solid fuel burner which is another example (Example 4) of the present disclosure.
Figure 12:
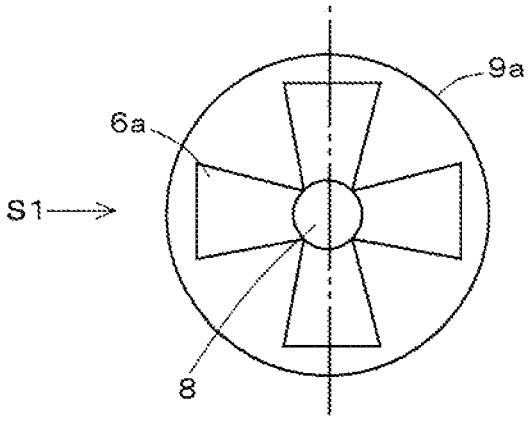
FIG. 12(A) is a front view of a first swirler in FIG. 11.
FIG. 12(B) is a view seen from S1 in FIG. 12(A)
FIG. 12(C) is a front view of a second swirler in FIG. 11.
FIG. 12(D) is a view seen from S2 in FIG. 12(C).
Figure 12:
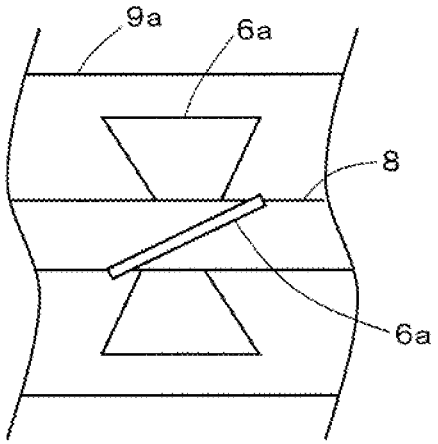
Figure 12:
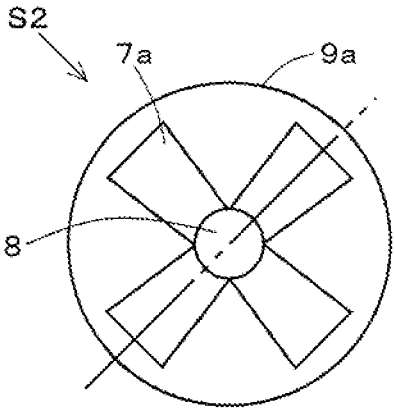
Figure 12:
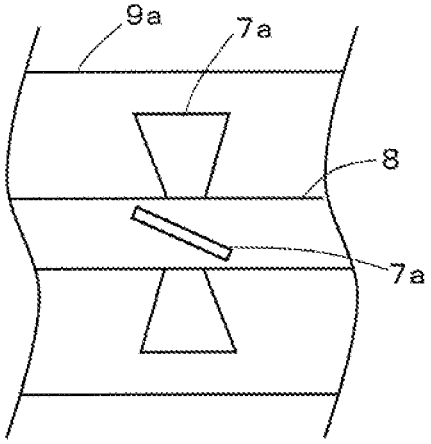

FIG. 11 is a side view (schematic view) illustrating a partial cross-section of a solid fuel burner 1 according to another example of the present disclosure. FIG. 12 illustrates a first swirler and a second swirler in FIG. 11, wherein FIGS. 12(A) and 12(C) are front views, respectively, FIG. 12(B) is a view seen from S1 in FIG. 12(A), and FIG. 12(D) is a view seen from S2 in FIG. 12(C).

In the present example, the lateral width of the vanes 7*a* of the second swirler 7 is set to be smaller than the lateral width of the vanes 6*a* of the first swirler 6, thus to have a narrow shape. The other configurations are the same as those of the solid fuel burner 1 according to Example 1. Therefore, the installation angle and the radial length of the vanes 6*a* and the vanes 7*a* are the same as those of Example 1. As such, even if the lateral width of the vanes 7*a* of the second swirler 7 and the lateral width of the vanes 6*a* of the first swirler 6 are changed, the same effects as those of Example 1 are obtained.

Figure 13:
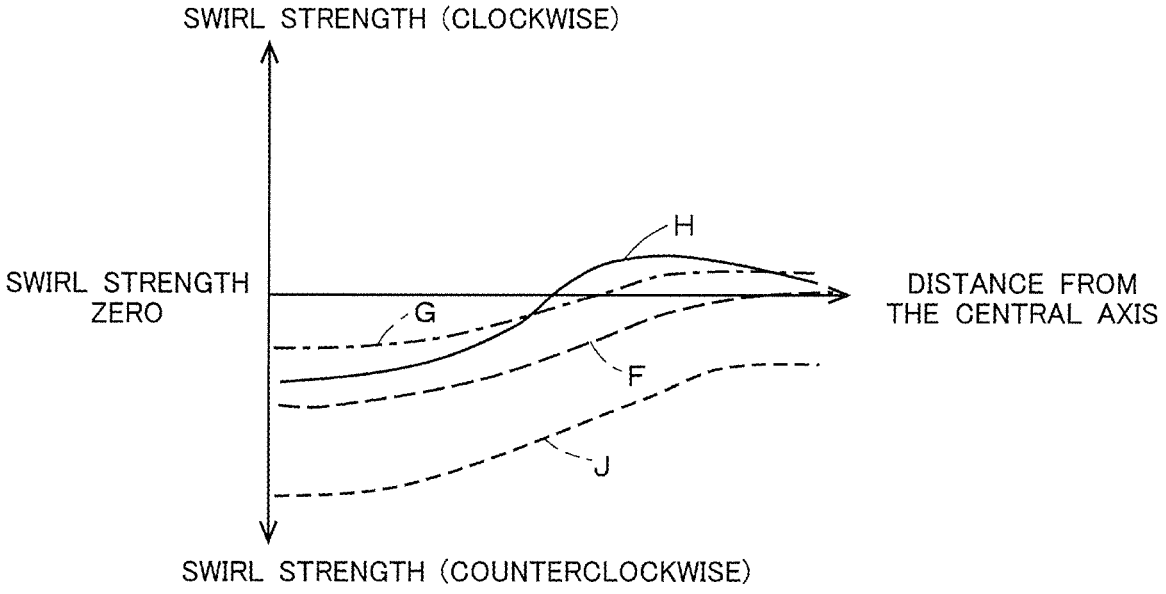
FIG. 13 is a diagram illustrating the swirl strength distribution in the vicinity of the burner outlet when the swirler is changed.

Hereinafter, the results of further intensive verification performed by changing three conditions of the installation angle, the radial length, and the lateral width of the respective vanes 6*a* and 7*a* of the first swirler 6 and the second swirler 7 are illustrated. FIG. 13 illustrates the swirl strength distributions in the vicinity of the burner outlet when the swirler is changed. The fluid analysis by the k-ε model was executed under a condition that the air and the pulverized coal flow at a rated load condition amount of the burner from the direction of an arrow A in FIG. 1 similar to the case of FIG. 4.

A broken line F illustrates a case in which the diameters of the respective vanes 6*a* and 7*a* are set to be 75% of the inner diameter of the primary air nozzle 9, and the installation angle is set to be 30° on both the upstream side and the downstream side in the exhaust gas flow direction. A one-dotted chain line G illustrates a case in which the diameter of the vanes 6*a* on the upstream side is set to be 75% of the inner diameter of the primary air nozzle 9, the installation angle is set to be 45°, the diameter of the vanes 7*a* on the downstream side is set to be 75% of the inner diameter of the primary air nozzle 9, and the installation angle is set to be 25°. A solid line H illustrates a case in which the diameter of the vanes 6*a* on the upstream side is set to be 75% of the inner diameter of the primary air nozzle 9, the installation angle is set to be 30°, the diameter of the vanes 7*a* on the downstream side is set to be 50% of the inner diameter of the primary air nozzle 9, and the installation angle is set to be 45°. A broken line J illustrates a case in which the diameter of the vanes 6*a* on the upstream side is set to be 75% of the inner diameter of the primary air nozzle 9, the installation angle is set to be 30°, the diameter of the vanes 7*a* on the downstream side is set to be 75% of the inner diameter of the primary air nozzle 9, and the installation angle is set to be 45°. The lateral widths of the respective vanes 6*a* and 7*a* were the same as each other.

Similar to the case of FIG. 4, the swirl strength distribution of the air at the burner outlet cross-section in the primary air nozzle 9 was calculated.

The condition necessary for improving the stability of the flame and suppressing the NOx emission amount is that the swirl strength on the outermost peripheral side of the primary air nozzle 9 is minimized as much as possible. Since the pulverized coal concentration on the outermost peripheral side of the primary air nozzle 9 is high, if the swirling strength in this region is strong, the pulverized coal on the outermost peripheral side scatters around the burner 1, such that the stability of the flame is deteriorated, and the NOx concentration is increased. Meanwhile, since there is not much pulverized coal near the central part of the primary air nozzle 9, an influence applied to the combustion performance is small, even if the swirl strength at the central part is strong.

In the broken line F (Example 1), the swirl strength at the central part of the primary air nozzle 9 is relatively large, but on the outer peripheral side of the primary air nozzle 9, the swirl strength becomes about zero. In addition, in the one-dotted chain line G (Example 2), the swirl strength at the central part of the primary air nozzle 9 becomes small. The swirl strength on the outer peripheral side is slightly larger than the broken line F, but it is a small value. Meanwhile, a case, in which the installation angle of the vanes 7*a* of the second swirler 7 is large, is indicated by a broken line J. In this case, the swirl strength is slightly increased also on the outer peripheral side of the primary air nozzle 9.

However, as illustrated by the solid line H, even if the installation angle of the vanes 7*a* of the second swirler 7 is large, when the diameter of the vanes 7*a* is small, it becomes to the swirl strength distribution similar to the one-dot chain line G. Further, when the average value of the swirl strength is taken over the entire region from the central part to the outer peripheral part, it becomes substantially zero.

Further, although not illustrated, the swirl strength distribution in a case (Example 4), in which the lateral width of the vanes 7*a* of the second swirler 7 is decreased, and the other conditions are the same as those of the vanes 6*a* of the first swirler 6, it also becomes the swirl strength distribution similar to Example 2 (one-dot chain line G). Accordingly, from this fact, it can be seen that, as a difference between the cases in which the lateral width of the vane 7*a* of the second swirler 7 is small and large, there is the same difference of action as the magnitude of the installation angle and the diameter of the vanes 7*a* of the second swirler 7.

From the above description, it is preferable that the vanes 7*a* of the second swirler 7 on the downstream side of the first swirler 6 satisfy the following conditions.

(1) The radial length of the vanes 7*a* is equal to or smaller than the radial length of the vanes 6*a* of the first swirler 6.

(2) The installation angle of the vanes 7*a* is equal to or smaller than the installation angle of the vanes 6*a*.

(3) The lateral width of the vanes 7*a* is equal to or smaller than the lateral width of the vanes 6*a*.

Figure 14:
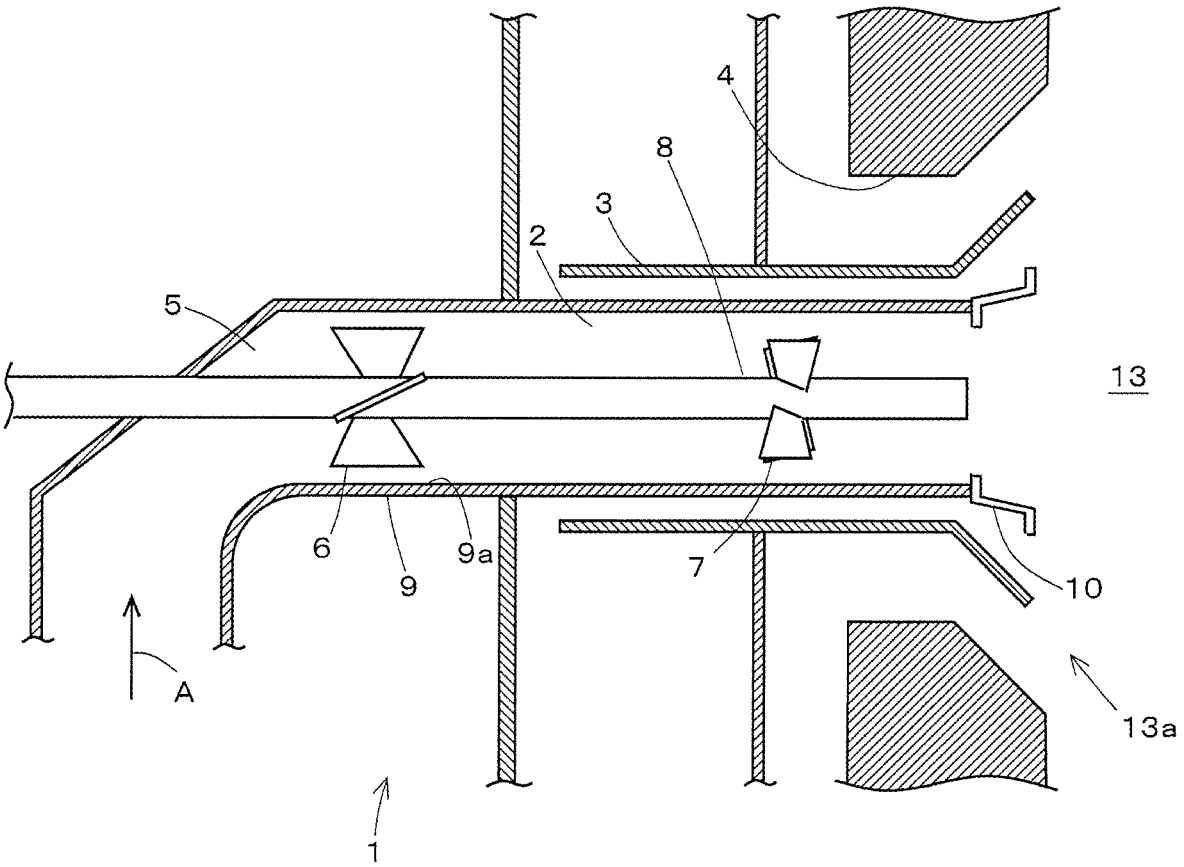
FIG. 14 is a side view illustrating a partial cross-section of a solid fuel burner which is another example (Example 4) of the present disclosure.

In addition, there is no particular limitation on the installation position and interval of the first swirler 6 and the second swirler 7. This is common to all examples. For example, as illustrated in FIG. 14, the first swirler 6 and the second swirler 7 may be installed away from each other as compared with other illustrated examples. Further, if the second swirler 7 is provided in the vicinity of the burner outlet, it is conceivable that a strong swirl component remains at the burner outlet, and the coal particles widely scatter in the furnace 13, and the NOx concentration is increased, such that it is preferable to slightly separate the second swirler from the outlet.

EXAMPLE 5

Figure 15:
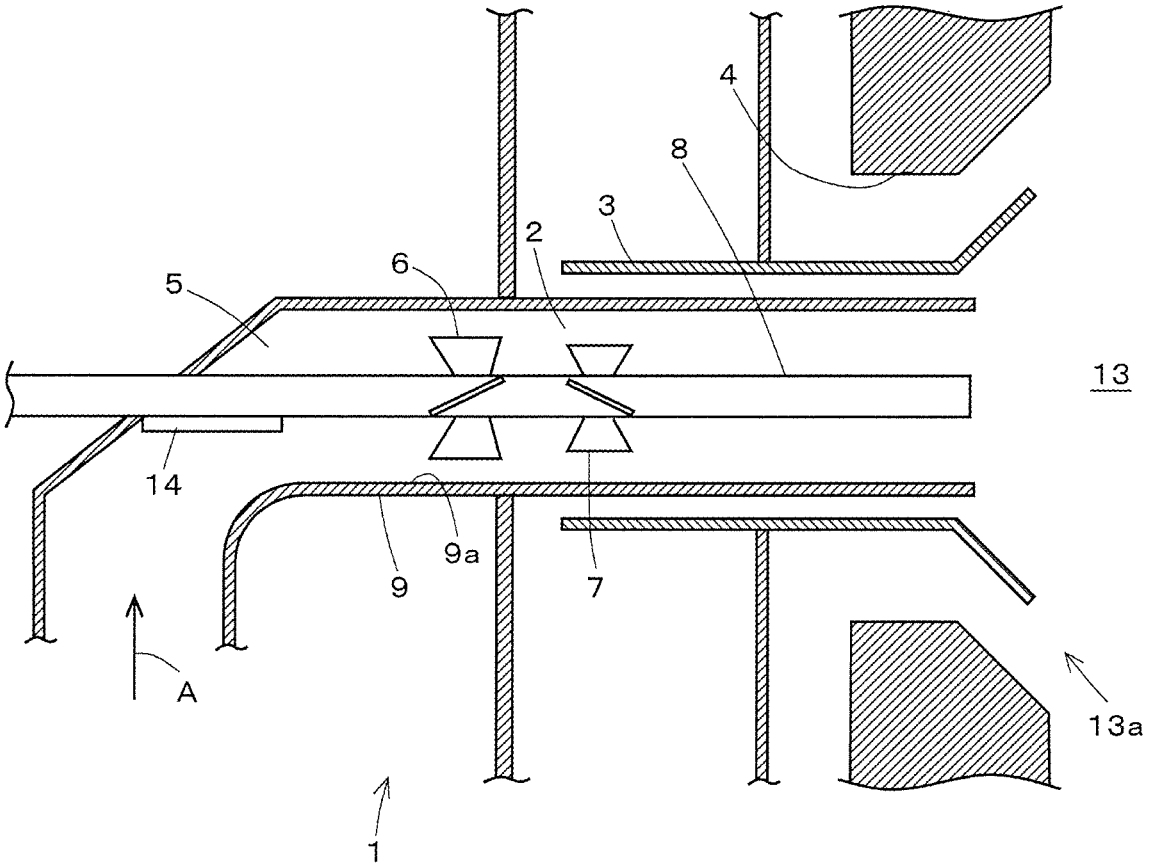
FIG. 15 is a side view illustrating a partial cross-section of a solid fuel burner which is another example (Example 5) of the present disclosure.

FIG. 15 illustrates a side view illustrating a partial cross-section of a solid fuel burner according to another example of the present disclosure. FIG. 16(A) illustrates a perspective view of major parts (inside of the nozzle 9) in FIG. 15, FIG. 16(B) illustrates a view of the major parts in FIG. 15, FIG. 16(C) illustrates a cross-sectional view taken and seen on line A-A in FIG. 16(B), and FIG. 16(D) illustrates a cross-sectional view taken and seen on line B-B in FIG. 16(B).

Figure 16:
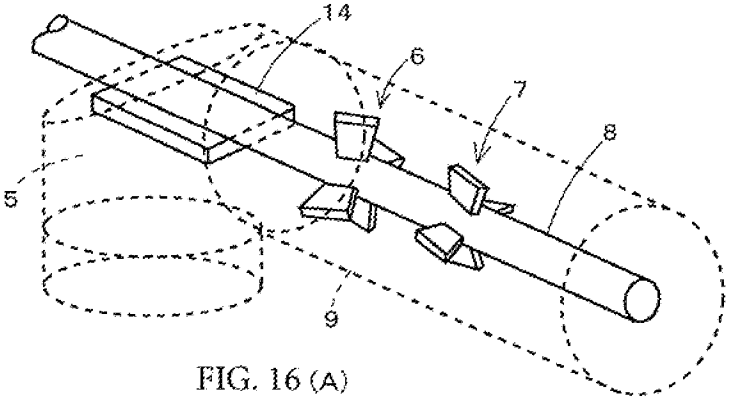
FIG. 16(A) is a perspective view of major parts in FIG. 15.
FIG. 16(B) is an enlarged view of the major parts in FIG. 15.
FIG. 16(C) is a cross-sectional view taken and seen on line A-A in FIG. 16(B)
FIG. 16(D) is a cross-sectional view taken and seen on line B-B in FIG. 16(B).
Figure 16:
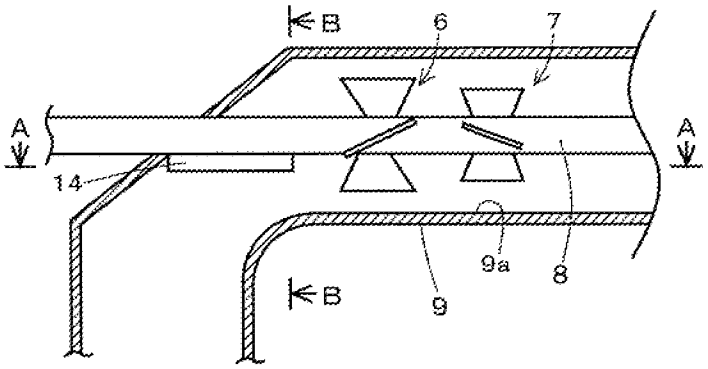
Figure 16:
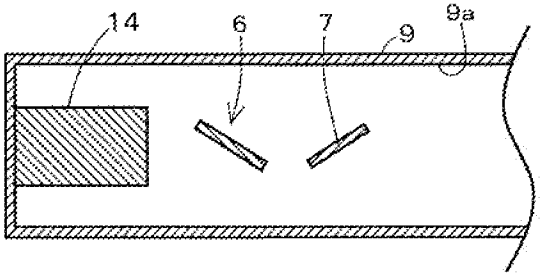
Figure 16:
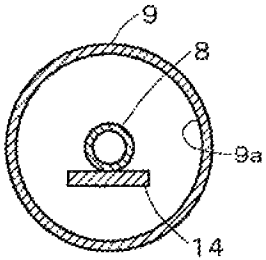

A solid fuel burner 1 of the present example is different from the solid fuel burner of the above-described respective examples in an aspect that a disperser 14 of pulverized coal particles is disposed on the upstream side of the first swirler 6 and in a space of the curved tube section 5 located on a root side of the oil burner 8, and the flame stabilizer 10 is not installed. Specifically as illustrated in FIG. 16, the disperser 14 is a plate-shaped member having a plane part, and is attached to, the lateral face of the oil burner 8 so that the plane part faces the upstream side of the curved section of the curved tube section 5.

That is, the plane part is directed to face the flow of the mixed fluid of the solid fuel and the carrier gas thereof introduced into the curved tube section 5. In addition, the first swirler 6 and the second swirler 7 are installed so that the respective vanes 6*a* and 7*a* are overlapped with each other as viewed from the furnace 13, but these swirlers may be disposed so as not to be overlapped with each other, as illustrated in Example 1 and the like.

Figure 17:
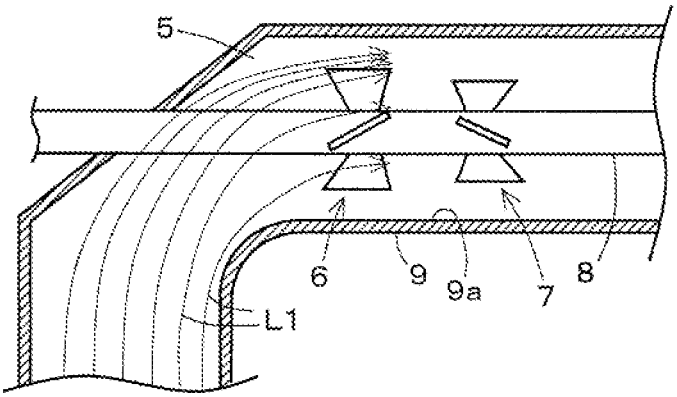
FIG. 17(A) is a side view and FIG. 17(B) is a front view illustrating a flow field of a mixed fluid when a particle disperser is not provided.
Figure 17:
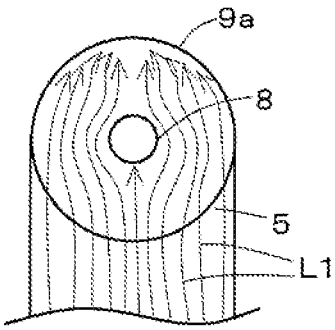
Figure 18A:
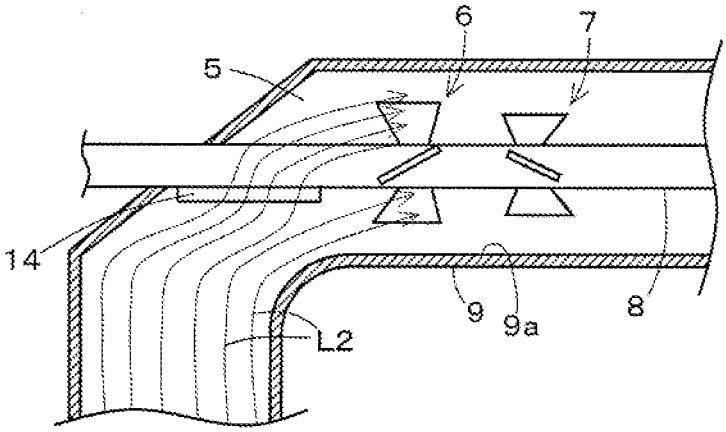
FIG. 18(A) is a side view and FIG. 18(B) is a front view illustrating a flow field of a mixed fluid when a particle disperser is provided.
Figure 18B:
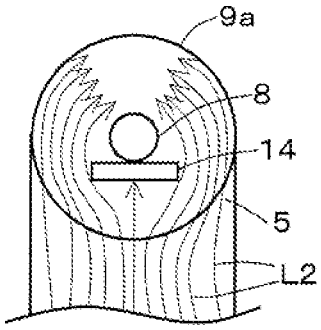

FIG. 17 is a schematic view illustrating a flow field of the mixed fluid of the burner 1 pursuant to FIG. 1 without the disperser 14, wherein FIG. 17(A) is a side view, and FIG. 17(B) is a front view FIG. 18 is a schematic view illustrating a flow field of the mixed fluid of the burner 1 in FIG. 15 provided with the disperser 14, wherein FIG. 18(A) is a side view, and FIG. 18(B) is a front view.

FIGS. 17 and 18 illustrate a difference in the flow field of the mixed fluid depending on the presence or absence of the disperser 14. First, the flow field in a case in which the disperser 14 of FIG. 17 is not provided will be described. The mixed fluid supplied from the lower side of the curved tube section 5 moves via the curved tube section 5, such that the direction of the flow in the outlet direction of the straight tube section 2 (in the central axis direction of the primary air nozzle 9) is bent by about 90°. At this time since the centrifugal force acts on the mixed fluid, when viewing the primary air nozzle 9 after passing through the curved tube section 5 as a cross-section, it becomes a state in which the pulverized coal is biased in the direction on which the centrifugal force acts. In the illustrated example, it shows the part in which the pulverized coal concentration in the vicinity of the inner wall 9*a* in an upper half of the primary air nozzle 9 is high. Even in this case, by applying the above-described first swirler 6 and the second swirler 7, it is possible to form a state in which the pulverized coal concentration exceeds the ignition lower limit concentration E (FIG. 6(B) even when the average pulverized coal concentration is low such as at the time of a low load or the like, but from the viewpoint of stable combustion of the burner, it is desirable to further enlarge the region in which the pulverized coal concentration exceeds the ignition lower limit concentration E.

Next, the flow field in a case in which the disperser 14 of FIG. 18 is provided will be described. In the present example, since the disperser 14 is disposed in the curved tube section 5, the disperser 14 becomes an obstacle when viewed from the mixed fluid supplied to the curved tube section 5. Thereby, the flow direction of the mixed fluid is changed in a direction (circumferential direction) bypassing the disperser 14. In addition, a part of the pulverized coal collides with the plane part of the disperser 14, and the concentration of the pulverized coal on the upper side (outside of the curved section) of the primary air nozzle 9 due to the centrifugal effect at the curved tube section 5 is mitigated. As a result, like a flow line L2, there is an effect of enlarging a high concentration region of the pulverized coal in the circumferential direction on the nozzle outer peripheral side by the first swirler 6 and the second swirler 7.

Figure 19:
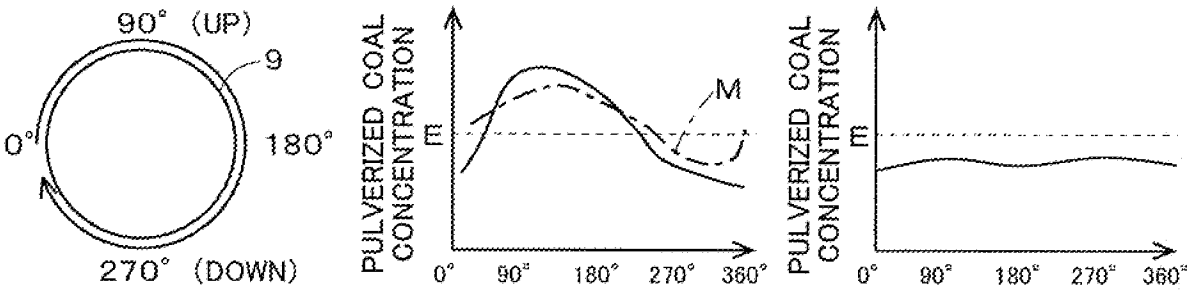
FIG. 19(A)-19(C) are diagrams comparing the circumferential concentration distributions on outlet outer peripheral sides of the burner of Example 5 and the burner of the comparative example at the time of a low load.

FIG. 19 illustrates the concentration distribution when the average pulverized coal concentration is low at the time of a low load. Similar to the case of FIG. 3, the fluid analysis by the k-ε model was executed. FIG. 19(B) is a diagram in which the concentration distribution (indicated by a one-dot chain line M) by the burner 1 of the present example is added to FIG. 6(B), and FIG. 19(C) is the same as FIG. 6(C).

According to the present example, the state in which the pulverized coal concentration concentrates on the upper side of the primary air nozzle 9 by the disperser 14 is mitigated, and the high concentration region of the pulverized coal acts so as to be enlarged in the circumferential direction. Accordingly, even when the average pulverized coal concentration is low, the mixed fluid is dispersed to the outer peripheral side of the primary air nozzle 9, whereby the region in which the pulverized coal concentration exceeds the ignition lower limit concentration E becomes wide, and stable combustion of the burner may be achieved.

Figure 20:
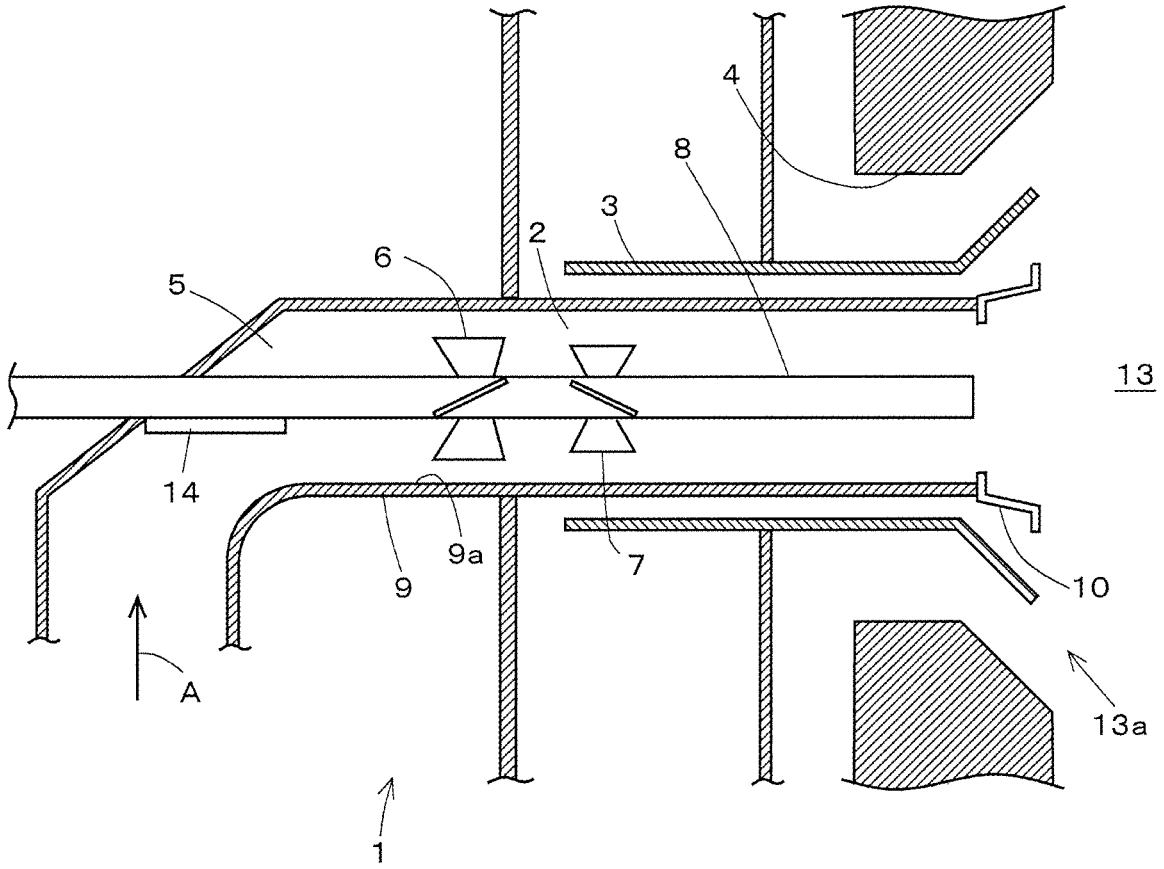
FIG. 20 is a side view illustrating a partial cross-section of a solid fuel burner which is another example (Example 5) of the present disclosure.

In addition, FIG. 15 and the like illustrate the case in which the radial length of the vanes 7*a* of the second swirler 7 is set to be shorter than the radial length of the vanes 6*a* of the first swirler 6, but the respective vanes 6*a* and 7*a* of the first swirler 6 and the second swirler 7 may be the same as or different from each other in terms of the installation angle, the radial length, and the lateral width, and of course, these configurations belong within the scope of the present example. In addition, as illustrated in FIG. 20, the flame stabilizer 10 may be installed in the burner 1 of FIG. 15, and in this case, the effects of improving the stability of the flame and reducing the NOx emission amount are further enhanced.

INDUSTRIAL APPLICABILITY

The present disclosure has industrial availability as a burner apparatus using a solid fuel.

DESCRIPTION OF REFERENCE NUMERALS

1, 21 solid fuel burner
2, 22 straight tube section
3 secondary air nozzle
4 tertiary air nozzle
5, 25 curved tube section
6 first swirler
7 second swirler
8 oil burner
9 primary air nozzle
10 flame stabilizer
13 furnace
14 particle disperser
23 secondary air supply pipe
24 tertiary air supply pipe
26 swirl vane
27 adjustment vane (straightening plate)
28 liquid fuel injection pipe
29 pulverized coal supply pipe

The invention claimed is:

1. A solid fuel burner provided in a throat of a wall surface of a furnace, comprising:

a fuel nozzle which includes a straight tube section provided around a burner central axis and having an opening toward the furnace and a curved tube section continued to the straight tube section, wherein a mixed fluid of a solid fuel and a carrier gas thereof supplied to the curved tube section is sprayed from the opening of the straight tube section to the furnace;

a first swirler which is provided on the burner central axis in the straight tube section, includes a plurality of vanes installed in the circumferential direction to apply a swirl to the mixed fluid; and a second swirler which is provided on the burner central axis downstream in a flow direction of the mixed fluid of the first swirler in the straight tube section, includes a plurality of vanes disposed in the circumferential direction, and is installed in a direction reverse to a direction in which vanes of the first swirler are installed, wherein the first swirler and the second swirler are provided away from an inner wall of the fuel nozzle, and are provided apart from each other on the burner central axis, and wherein the second swirler is separated from the opening of the straight tube section so that the swirling flow of the mixed fluid is weakened or disappears.

2. The solid fuel burner according to claim 1, wherein a flame stabilizer is provided on the outer periphery of the opening of the straight tube section.

3. The solid fuel burner according to claim 1, wherein respective vanes of the second swirler are installed so that an installation angle of the respective vanes of the second swirler with respect to a burner central axis direction is equal to or smaller than the installation angle of the respective vanes of the first swirler with respect to the burner central axis direction.

4. The solid fuel burner according to claim 1, wherein a radial length of the respective vanes of the second swirler is equal to or shorter than the radial length of respective vanes of the first swirler.

5. The solid fuel burner according to claim 1, wherein a lateral width of respective vanes of the second swirler is the same as or smaller than the lateral width of respective vanes of the first swirler.

6. The solid fuel burner according to claim 1, wherein a disperser for solid fuel particles is provided in the curved tube section.

7. The solid fuel burner according to claim 6, wherein the disperser is installed on a lateral face of an oil burner provided on the burner central axis on a side facing a flow of the mixed fluid.

8. The solid fuel burner according to claim 2, wherein respective vanes of the second swirler are installed so that an installation angle of the respective vanes of the second swirler with respect to a burner central axis direction is equal to or smaller than the installation angle of the respective vanes of the first swirler with respect to the burner central axis direction.

9. The solid fuel burner according to claim 2, wherein a radial length of the respective vanes of the second swirler is equal to or shorter than the radial length of respective vanes of the first swirler.

10. The solid fuel burner according to claim 2, wherein a lateral width of respective vanes of the second swirler is the same as or smaller than the lateral width of respective vanes of the first swirler.

11. The solid fuel burner according to claim 2, wherein a disperser for solid fuel particles is provided in the curved tube section.

12. The solid fuel burner according to claim 3, wherein a disperser for solid fuel particles is provided in the curved tube section.

13. The solid fuel burner according to claim 4, wherein a disperser for solid fuel particles is provided in the curved tube section.

14. The solid fuel burner according to claim 5, wherein a disperser for solid fuel particles is provided in the curved tube section.

* * * * *